US009165558B2

(12) United States Patent
Dressler et al.

(10) Patent No.: US 9,165,558 B2
(45) Date of Patent: Oct. 20, 2015

(54) SYSTEM FOR DYNAMICALLY CREATING AND RENDERING AUDIO OBJECTS

(75) Inventors: Roger Wallace Dressler, Bend, CA (US); Pierre-Anthony Stivell Lemieux, San Mateo, CA (US); Alan D. Kraemer, Irvine, CA (US)

(73) Assignee: DTS LLC, Calabasas, CA (US)

( * ) Notice: Subject to any disclaimer, the term of this patent is extended or adjusted under 35 U.S.C. 154(b) by 845 days.

(21) Appl. No.: 13/415,587

(22) Filed: Mar. 8, 2012

(65) Prior Publication Data

US 2012/0230497 A1 Sep. 13, 2012

Related U.S. Application Data

(60) Provisional application No. 61/451,085, filed on Mar. 9, 2011, provisional application No. 61/583,509, filed on Jan. 5, 2012.

(51) Int. Cl.
*H04R 5/00* (2006.01)
*G10L 19/008* (2013.01)

(52) U.S. Cl.
CPC ..... *G10L 19/008* (2013.01)

(58) Field of Classification Search
USPC ..... 381/17, 19–23, 119; 700/94; 704/500–504
See application file for complete search history.

(56) References Cited

U.S. PATENT DOCUMENTS

| | | | |
|---|---|---|---|
| 4,332,979 | A | 6/1982 | Fischer |
| 5,592,588 | A | 1/1997 | Reekes et al. |
| 6,108,626 | A | 8/2000 | Cellario et al. |
| 6,160,907 | A | 12/2000 | Robotham et al. |
| 7,006,636 | B2 | 2/2006 | Baumgarte et al. |
| 7,116,787 | B2 | 10/2006 | Faller |
| 7,164,769 | B2 | 1/2007 | Beard |
| 7,292,901 | B2 | 11/2007 | Baumgarte et al. |
| 7,295,994 | B2 | 11/2007 | Yoshida et al. |
| 7,394,903 | B2 | 7/2008 | Herre et al. |
| 7,583,805 | B2 | 9/2009 | Baumgarte et al. |
| 7,680,288 | B2 | 3/2010 | Melchior et al. |
| 2003/0219130 | A1 | 11/2003 | Baumgarte et al. |
| 2005/0033661 | A1 | 2/2005 | Yoshida et al. |

(Continued)

FOREIGN PATENT DOCUMENTS

| | | |
|---|---|---|
| CN | 1330470 A | 1/2002 |
| JP | 2002-204437 | 7/2002 |

(Continued)

OTHER PUBLICATIONS

AES Convention Paper Presented at the 107th Convention, Sep. 24-27, 1999, New York "Room Simulation for Multichannel Film and Music" Knud Bank Christensen and Thomas Lund.

AES Convention Paper Presented at the 124th Convention, May 17-20, 2008, Amsterdam, The Netherlands "Spatial Audio Object Coding (SAOC)" The Upcoming MPEG Standard on Parametric Object Based Audio Coding.

(Continued)

*Primary Examiner* — Vivian Chin
*Assistant Examiner* — Friedrich W Fahnert
(74) *Attorney, Agent, or Firm* — Knobbe Martens Olson & Bear LLP

(57) ABSTRACT

Embodiments of systems and methods are described for providing backwards compatibility for legacy devices that are unable to natively render non-channel based audio objects. These systems and methods can also be beneficially used to produce a reduced set of audio objects for compatible object-based decoders with low computing resources.

18 Claims, 12 Drawing Sheets

(56) References Cited

U.S. PATENT DOCUMENTS

| | | | |
|---|---|---|---|
| 2005/0105442 | A1 | 5/2005 | Melchior et al. |
| 2005/0147257 | A1 | 7/2005 | Melchior et al. |
| 2006/0206221 | A1 | 9/2006 | Metcalf |
| 2008/0005347 | A1 | 1/2008 | Ott |
| 2008/0140426 | A1 | 6/2008 | Kim et al. |
| 2008/0310640 | A1 | 12/2008 | Oh et al. |
| 2009/0034613 | A1 | 2/2009 | Youm |
| 2009/0060236 | A1 | 3/2009 | Johnston et al. |
| 2009/0082888 | A1 | 3/2009 | Johansen |
| 2009/0164222 | A1 | 6/2009 | Kim et al. |
| 2009/0225993 | A1 | 9/2009 | Cvetkovic |
| 2009/0237564 | A1 | 9/2009 | Kikinis et al. |
| 2009/0326960 | A1 | 12/2009 | Breebaat |
| 2010/0135510 | A1 | 6/2010 | Yoo et al. |
| 2011/0013790 | A1 | 1/2011 | Hilpert et al. |
| 2011/0040395 | A1 | 2/2011 | Kraemer et al. |
| 2012/0057715 | A1 | 3/2012 | Johnston et al. |
| 2012/0082319 | A1 | 4/2012 | Jot et al. |

FOREIGN PATENT DOCUMENTS

| | | |
|---|---|---|
| JP | 2005-086537 | 3/2005 |
| JP | 2007-281640 | 10/2007 |
| WO | WO 2007/136187 | 11/2007 |
| WO | WO 2008/035275 | 3/2008 |
| WO | WO 2008/084436 | 7/2008 |
| WO | WO 2008/143561 | 11/2008 |
| WO | WO 2009/001277 | 12/2008 |
| WO | WO 2009/001292 | 12/2008 |

OTHER PUBLICATIONS

International Search Report in corresponding PCT Application No. PCT/US2011/050885.

International Preliminary Report on Patentability issued in corresponding PCT Application No. PCT/US2012/28325 on Feb. 15, 2013.

Advanced Multimedia Supplements API for Java 2 Micro Edition, May 17, 2005, JSR-234 Expert Group.

Ahmed et al. Adaptive Packet Video Streaming Over IP Networks: A Cross-Layer Approach [online]. IEEE Journal on Selected Areas in Communications, vol. 23, No. 2 Feb. 2005 [retrieved on Sep. 25, 2010]. Retrieved from the internet <URL: hllp://bcr2.uwaterloo.ca/~rboutaba/Papers/Journals/JSA-5_2.pdf> entire document.

Amatriain et al, Audio Content Transmission [online]. Proceeding of the COST G-6 Conference on Digital Audio Effects (DAFX-01). 2001. [retrieved on Sep. 25, 2010]. Retrieved from the Internet <URl: http://www.csis.ul.ieldafx01lproceedingsipapers/am:atrlaln.pdf> pp. 1-6.

Engdegard et al., Spatial Audio Object Coding (SAOC)—The Upcoming MPEG Standard on Parametric Object Based Audio Coding, May 17-20, 2008.

Gatzsche et al., Beyond DCI: The Integration of Object-Oriented 3D Sound Into the Digital Cinema, In Proc. 2008 NEM Summit, pp. 247-251. Saint-Malo, Oct. 15, 2008.

Goor et al. An Adaptive MPEG-4 Streaming System Based on Object Prioritisation [online]. ISSC. 2003. [retrieved on Sep. 25, 2010]. Retrieved from the Internet <URL: http://www.csis.ul.ie/dafx01/proceedings/papers/amatriain.pdf> pp. 1-5, entire document.

International Search Report and Written Opinion for PCT/US10/45530 mailed Sep. 30, 2010.

International Search Report and Written Opinion for PCT/US10/45532 mailed Oct. 25, 2010.

International Preliminary Report on Patentability issued in application No. PCT/US2010/045532 on Feb. 14, 2012.

International Preliminary Report on Patentability issued in application No. PCT/US2010/045530 on Sep. 28, 2011.

ISO/IEC 23003-2:2010(E) International Standard—Information technology—MPEG audio technologies—Part 2: Spatial Audio Object Coding (SAOC), Oct. 1, 2010.

Jot, et al. Beyond Surround Sound—Creation, Coding and Reproduction of 3-D Audio Soundtracks. Audio Engineering Society Convention Paper 8463 presented at the 131st Convention Oct. 2-23, 2011.

MPEG-7 Overview, Standard [online]. International Organisation for Standardisation. 2004 [retrieved on Sep. 25, 2010). Retrieved from the Internet: <URL: http//mpeg.chiariglione.org/standards/mpeg-7/mpeg-7.htm> entire document.

Potard et al., Using XML Schemas to Create and Encode Interactive 3-D Audio Scenes for Multimedia and Virtual Reality Applications, 2002.

Pulkki, Ville. Virtual Sound Source Positioning Using Vector Base Amplitude Panning. Audio Engineering Society, Inc. 1997.

Sontacchi et al. Demonstrator for Controllable Focused Sound Source Reproduction. [online] 2008. [retrieved on Sep. 28, 2010). Retrieved from the internet: <URL: htlp://iem.at/projekte/publlcatlons/paper/demonstrar/demonstrator.pdf> entire document.

International Search Report and Written Opinion issued in application No. PCT/US2012/028325 on Aug. 6, 2012.

Office Action issued in Japanese Application No. 2012-524921 on May 20, 2014.

Office Action issued in Chinese Application No. 201080041989.0 on Dec. 21, 2012.

Office Action issued in Chinese Application No. 201080041993.7 on Jun. 13, 2013.

Office Action issued in Chinese Application No. 201080041993.7 on Dec. 16, 2013.

Office action issued in Chinese application No. 201080041993.7 on Dec. 12, 2012.

Office Action issued in Japanese application No. 2012-524919 on Jun. 17, 2014.

Adistambha et al., "An Investigation into Embedded Audio Coding Using an AAC Perceptually Lossless Base Layer", Proceedings of the 10th Australian International Conference on Speech Science & Technology Macquarie University, Sydney, Dec. 8-10, 2004.

International Search Report and Written Opinion issued in application No. PCT/US2014/033049 on Aug. 13, 2014.

Salomon David, "Data Compression: the complete reference, Dictionary Methods", pp. 101-107, Jan. 1, 1998.

SYSTEM FOR DYNAMICALLY CREATING AND RENDERING AUDIO OBJECTS

RELATED APPLICATIONS

This application claims the benefit of priority under 35 U.S.C. §119(e) of U.S. Provisional Application No. 61/451,085, filed on Mar. 9, 2011, and entitled "System for Dynamically Creating and Rendering Audio Objects," and U.S. Provisional Application No. 61/583,509, filed Jan. 5, 2012, and entitled "Hybrid Object-Based Audio System," the disclosures of both of which are hereby incorporated by reference in their entirety.

BACKGROUND

Existing audio distribution systems, such as stereo and surround sound, are based on an inflexible paradigm implementing a fixed number of channels from the point of production to the playback environment. Throughout the entire audio chain, there has traditionally been a one-to-one correspondence between the number of channels created and the number of channels physically transmitted or recorded. In some cases, the number of available channels is reduced through a process known as downmixing to accommodate playback configurations with fewer reproduction channels than the number provided in the transmission stream. Common examples of downmixing are mixing stereo to mono for reproduction over a single speaker and mixing multi-channel surround sound to stereo for two-speaker playback.

Typical channel-based audio distribution systems are also unsuited for 3D video applications because they are incapable of rendering sound accurately in three-dimensional space. These systems are limited by the number and position of speakers and by the fact that psychoacoustic principles are generally ignored. As a result, even the most elaborate sound systems create merely a rough simulation of an acoustic space, which does not approximate a true 3D or multi-dimensional presentation.

SUMMARY

For purposes of summarizing the disclosure, certain aspects, advantages and novel features of the inventions have been described herein. It is to be understood that not necessarily all such advantages can be achieved in accordance with any particular embodiment of the inventions disclosed herein. Thus, the inventions disclosed herein can be embodied or carried out in a manner that achieves or optimizes one advantage or group of advantages as taught herein without necessarily achieving other advantages as can be taught or suggested herein.

In certain embodiments, a method of encoding object-based audio includes, for each audio object of a plurality of audio objects: accessing the audio object, the audio object having attribute metadata and audio signal data, analyzing one or both of the attribute metadata and the audio signal data with respect to one or more object selection rules, and assigning the audio object to be either a base object or an extension object based at least in part on the analyzing. A first number of the audio objects can be assigned to be base objects and a second number of the audio objects can be assigned to be extension objects. Further, the method can include rendering the base objects and the extension objects to produce channels of audio; and making the channels of audio available to a receiver together with the extension objects (e.g., by transmitting or by providing the channels and extension objects to a component that transmits them). As a result, in some embodiments, the method enables the receiver to render the extension objects separately from the audio channels if the receiver is capable of doing so while still enabling the receiver to output the audio channels if the receiver is not capable of rendering the extension objects.

In some embodiments, a system for encoding object-based audio includes an extension selector having one or more processors. The extension selector can, for each audio object of a plurality of audio objects, access the audio object, where the audio object includes attribute metadata and audio signal data. The extension selector can also analyze one or both of the attribute metadata and the audio signal data with respect to one or more object selection rules. Further, the extension selector can assign the audio object to be either a base object or an extension object based at least in part on said analyzing, such that a first number of the audio objects are assigned to be base objects and a second number of the audio objects are assigned to be extension objects. The system can also include a renderer that can render the base objects and the extension objects to produce core objects. The core objects and the extension objects can be provided to a receiver, thereby enabling the receiver to render the extension objects separately from the core objects if the receiver is capable of doing so while still enabling the receiver to render the core objects if the receiver is not capable of rendering the extension objects.

Various embodiments of a method of decoding object-based audio include receiving, with a receiver having one or more processors, a plurality of audio objects, where the audio objects include one or more channels of audio and a plurality of extension objects. The method can also include rendering at least some of the extension objects with the receiver to produce rendered extension audio and combining the one or more audio channels with the rendered extension audio to produce output audio channels. This combining can include attenuating or removing the rendered extension audio from the one or more audio channels. Moreover, the method can include rendering the at least some of the extension objects into enhanced extension audio and providing the output audio channels and the enhanced extension audio as output audio.

A system for decoding object-based audio can also include a detail selector that can receive a plurality of audio objects, where the audio objects have one or more channels of audio, and a plurality of extension objects. A first extension renderer in the system can render at least some of the extension objects to produce rendered extension audio. In addition, a reverse combiner of the system can combine the one or more audio channels with the rendered extension audio to produce output audio channels. This combining performed by the renderer can include attenuating or removing the rendered extension audio from the one or more audio channels. Further, the system can include a second extension renderer that can render the at least some of the extension objects into enhanced extension audio and provide the output audio channels and the enhanced extension audio as output audio.

BRIEF DESCRIPTION OF THE DRAWINGS

Throughout the drawings, reference numbers are re-used to indicate correspondence between referenced elements. The drawings are provided to illustrate embodiments of the inventions described herein and not to limit the scope thereof.

DETAILED DESCRIPTION

I. Introduction

Figure 1:
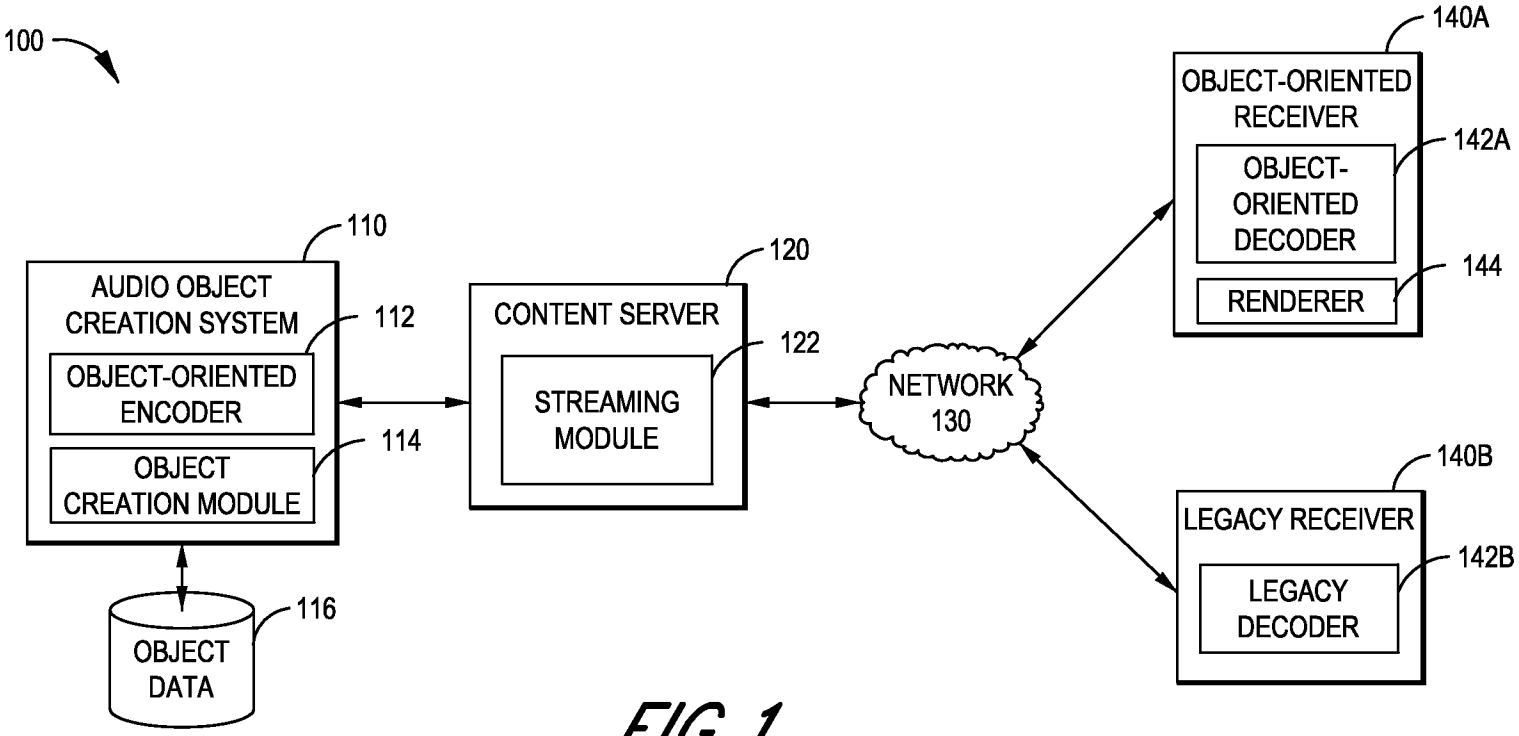
FIG. 1 illustrates an embodiment of an object-based audio system.

Audio objects can be created by associating sound sources with attributes of those sound sources, such as location, velocity, directivity, and the like. Audio objects can be used in place of or in addition to channels to distribute sound, for example, by streaming the audio objects over a network to a client device. Object-based soundfield representation and encoding can offer many advantages over the commonly used speaker-based or channel-based representation. For instance, object-based audio coding can preserve more of the information created on the soundstage, including positional information, and hence more of the creative intent. Object-based audio coding can also make translating a soundfield to different loudspeaker configurations more predictable. Improved discreteness of the delivered sounds can also allow optional post-processing to be applied to the selected sound elements without unintentionally affecting other sounds.

While there are many potential use cases for object-based audio, two primary ones shall be mentioned as illustrative of the potential benefits. First is the concept of spatially remapping the sounds to different playback system speaker configurations, with the goal being to best maintain the intentions of the program creator. Second is to allow the user or playback system to make adjustments in how the program can be reproduced to suit certain desires. Various examples relate to adjusting the relative levels of the audio objects to alter the program's effect. For example, a listener might like to enhance the level of the vocals relative to the background music, or to suppress the level of crowd noise in a sports program. A more extreme case would be to completely remove certain sounds, such as the main vocalist for a Karaoke application. The most extreme case might be to isolate one single element of the program, such as the dialog, to aid hearing impaired listeners.

Despite the potential benefits of object-based audio, it may not always be desirable to store or transmit an object-based soundfield as a collection of all its constituent audio objects. First, it can be often desirable to transmit a representation of the object-based soundfield that offers compatibility with legacy devices, including devices that cannot render object-based soundfields but instead support traditional speaker-feeds. Second, it may not be practical, or artistically necessary, to store or transmit the entire soundfield in object-based form if it includes a very large number of objects. In many instances, multiple objects may be combined into a smaller number of objects without impairing the listening experience. Third, it can be often desirable to store or transmit a soundfield representation that can be scalable, for example, that allows delivery systems with insufficient bandwidth to deliver a subset of the representation, or that allows rendering devices with insufficient processing capabilities to render a subset of the representation.

This disclosure describes, among other features, embodiments of systems and methods for providing backwards compatibility for multi-channel infrastructure-based legacy devices that are unable to natively render non-channel based audio objects. These systems and methods can also be beneficially used to produce a reduced set of objects for compatible object-based decoders with low computing resources.

In one embodiment, an audio creation system described herein can allow a sound engineer or other content creator user to create audio objects by associating sound sources with attributes of those sound sources, such as location, velocity, directivity, downmix parameters to specific speaker locations, sonic characteristics such as divergence or radiation pattern, and the like. Audio objects can be used in place of or in addition to channels to distribute sound, for example, by streaming or by storing the objects on storage media (such as DVDs or Blu-ray Discs) or in memory caches in disc players, set-top boxes, hard drives, or other devices. These objects can initially be defined independent of audio channels or of panned positions between channels. For example, the objects can be defined based on locations in space of the sound sources with associated two or three dimensional coordinates. Audio objects can be rendered based on the attribute information encoded in the objects. For instance, a renderer can decide which speaker or speakers to render an object on based on the object's coordinates, among other metadata.

To provide backwards compatibility, in one embodiment the audio creation system maps the created audio objects to one or more channels, such as mono, stereo, or surround channels (e.g., 5.1 channels, 7.1 channels, or the like). The audio creation system can provide the channels of audio to a rendering system (e.g., via streaming or a storage device) together with one or more of the audio objects as separate extension objects. Receiving systems that are able to render the extension objects can do so instead of or in addition to rendering the channel objects. Legacy receivers can process the audio channels while ignoring the extension objects. In addition, object-compatible receiving systems with low processing resources compared to other systems can render a subset of the extension objects in addition to the audio channels at least in some embodiments.

One potential side effect of streaming a dynamic number of discrete audio objects (e.g., extension objects) over a network is that the audio stream can have a variable bitrate. If the peak bitrate exceeds acceptable levels (e.g., based on network bandwidth or other factors), extension objects (or portions thereof) may not arrive in time to be rendered with corresponding core objects. If the audio stream is buffered, the late arrival of extension objects may not pose a problem to playback of a complete audio presentation, as playback can be delayed until the buffer receives the extension objects. However, in playback scenarios that begin playback without buffering, substantially instantaneously, a receiver may begin playing received core objects before extension objects arrive. When the extension objects arrive, the receiver may then begin rendering the extension objects together with (or in place of) the core objects. The transition between initial constrained playback without extension object rendering and playback of a complete presentation with extension object rendering can be noticeable to a listener and may be perceived as having initial poor playback quality.

To address this or possibly other drawbacks, systems and methods described herein can also transmit other forms of object representations together with audio objects, which a receiver can render at least until objects arrive at the receiver. These object representations may include object reconstruction information that enables objects to be reconstructed at least in part. The object representations may be very compact and add little to the bitrate of the audio stream. One example object representation is parametric data, described in more detail below. However, other forms of object representation besides parametric data may be used.

A hybrid object-based receiver can receive the parametric data along with at least the core channel objects and begin playback of the audio while rendering the parametric data. The rendering of the parametric data can provide at least a partially enhanced audio effect at least until certain objects (such as extension objects) arrive at the receiver. Once the object information arrives, the receiver can crossfade into rendering the object information. Crossfading can include fading the parametric-rendered audio out while fading in the object-rendered audio. This transition from parametric data rendering to object rendering may be less perceptible to a user than the jarring transition in the delayed rendering scenario described above.

II. Object-Based Audio System Overview

By way of overview, FIG. 1 illustrates an embodiment of an object-based audio environment 100. The object-based audio environment 100 can enable content creator users to create and stream audio objects to receivers, which can render the objects without being bound to the fixed-channel model. The object-based audio environment 100 can also provide object-based audio streams that include backwards compatible audio channels for legacy receivers. Moreover, the object-based audio environment 100 can provide mechanisms for enabling receivers to deal with variable bitrates introduced by audio streams having a variable number or size of objects. These mechanisms are described in detail below with respect to FIGS. 7 through 12. The various components of the object-based audio environment 100 can be implemented in computer hardware and/or software.

In the depicted embodiment, the object-based audio environment 100 includes an audio object creation system 110, a streaming module 122 implemented in a content server 120 (for illustration purposes), and receivers 140A, 140B. By way of overview, the audio object creation system 110 can provide functionality for content creators to create and modify audio objects. The streaming module 122, shown optionally installed on a content server 120, can be used to stream audio objects to a receiver 140 over a network 130. The network 130 can include a local area network (LAN), a wide area network (WAN), the Internet, or combinations of the same. The receivers 140A, 140B can be end-user systems that render received audio for output to one or more loudspeakers (not shown).

In the depicted embodiment, the audio object creation system 110 includes an object creation module 114 and an object-based encoder 112. The object creation module 114 can provide tools for creating objects, for example, by enabling audio data to be associated with attributes such as position, velocity, and so forth. Any type of audio can be used to generate an audio object, including, for example, audio associated with movies, television, movie trailers, music, music videos, other online videos, video games, advertisements, and the like. The object creation module 114 can provide a user interface that enables a content creator user to access, edit, or otherwise manipulate audio object data. The object creation module 114 can store the audio objects in an object data repository 116, which can include a database, file system, or other data storage.

Audio data processed by the audio object creation module 114 can represent a sound source or a collection of sound sources. Some examples of sound sources include dialog, background music, and sounds generated by any item (such as a car, an airplane, or any moving, living, or synthesized thing). More generally, a sound source can be any audio clip. Sound sources can have one or more attributes that the object creation module 114 can associate with the audio data to create an object, automatically or under the direction of a content creator user. Examples of attributes include a location of the sound source, a velocity of a sound source, directivity of a sound source, downmix parameters to specific speaker locations, sonic characteristics such as divergence or radiation pattern, and the like.

Some object attributes may be obtained directly from the audio data, such as a time attribute reflecting a time when the audio data was recorded. Other attributes can be supplied by a content creator user to the object creation module 114, such as the type of sound source that generated the audio (e.g., a car, an actor, etc.). Still other attributes can be automatically imported by the object creation module 114 from other devices. As an example, the location of a sound source can be retrieved from a Global Positioning System (GPS) device coupled with audio recording equipment and imported into the object creation module 114. Additional examples of attributes and techniques for identifying attributes are described in greater detail in U.S. application Ser. No. 12/856,442, filed Aug. 12, 2010, titled "Object-Oriented Audio Streaming System" ("the '442 application"). The systems and methods described herein can incorporate any of the features of the '442 application, and the '442 is hereby incorporated by reference in its entirety.

The object-based encoder 112 can encode one or more audio objects into an audio stream suitable for transmission over a network. In one embodiment, the object-based encoder 112 encodes the audio objects as uncompressed LPCM (linear pulse code modulation) audio together with associated attribute metadata. In another embodiment, the object-based encoder 112 also applies compression to the objects when creating the stream. The compression may take the form of lossless or lossy audio bitrate reduction as may be used in disc and broadcast delivery formats, or the compression may take the form of combining certain objects with like spatial/temporal characteristics, thereby providing substantially the same audible result with reduced bitrate. In one embodiment, the audio stream generated by the object-based encoder includes at least one object represented by a metadata header and an audio payload. The audio stream can be composed of frames, which can each include object metadata headers and audio payloads. Some objects may include metadata only and no audio payload. Other objects may include an audio payload but little or no metadata, examples of which are described in the '442 application.

Advantageously, in certain embodiments, the object-based encoder 112 renders some or all of the audio objects into audio channels that are backwards-compatible with channel-based audio receivers (e.g., the legacy receiver 140B). The object-based encoder 112 can output the audio channels together with at least some of the audio objects as supplemental or extension objects. As a result, legacy receivers 140B unable to render audio objects can simply play the audio channels, ignoring the audio objects as unrecognized auxiliary data. In contrast, the object-based receivers (140A) can optionally render the supplemental or extension objects instead of or in addition to rendering the audio channels.

The audio object creation system 110 can supply the encoded audio objects to the content server 120 over a network (not shown). The content server 120 can host the encoded audio objects for later transmission. The content server 120 can include one or more machines, such as physical computing devices. The content server 120 can be accessible to the receivers 140 over the network 130. For instance, the content server 120 can be a web server, an application server, a cloud computing resource (such as a virtual machine instance), or the like.

The receivers 140A, 140B can access the content server 120 to request audio content. In response to receiving such a request, the content server 120 can stream, upload, or otherwise transmit the audio content to one or more of the receivers 140A, 140B. The receivers 140A, 140B can be any form of electronic audio device or computing device. For example, either of the receivers 140A, 140B can be a desktop computer, laptop, tablet, personal digital assistant (PDA), television, wireless handheld device (such as a smartphone), sound bar, set-top box, audio/visual (AV) receiver, home theater system component, combinations of the same, or the like.

In the depicted embodiment, the receiver 140A is an object-based receiver having an object-based decoder 142A and renderer 144. The object-based receiver 140A can decode and play back audio objects in addition to or instead of decoding and playing audio channels. The renderer 144 can render the decoded audio objects to one or more output channels that may or may not be in common with the audio channels defined in the backwards-compatible audio content. Advantageously, in certain embodiments, the renderer 144 has more flexibility in applying audio effects or enhancements (including optionally psychoacoustic enhancements) to the audio objects than the legacy receiver 140B. This flexibility can result from having direct access to discrete audio objects rather than trying to extract these sounds from a channel-based mix, as is the challenge for legacy receivers. These objects may then be effectively processed based on attributes encoded with the audio objects, which can provide cues on how to render the audio objects. For example, an object might represent a plane flying overhead with speed and position attributes. The renderer 144 can intelligently direct audio data associated with the plane object to different audio channels (and hence speakers) over time based on the encoded position and speed of the plane. Another example of a renderer 144 is a depth renderer, which can produce an immersive sense of depth for audio objects. Embodiments of a depth renderer that can be implemented by the renderer 144 of FIG. 1 are described in U.S. application Ser. No. 13/342,743, filed Jan. 3, 2012, titled "Immersive Audio Rendering System," the disclosure of which is hereby incorporated by reference in its entirety.

It is also possible in some embodiments to effectively process objects based on criteria other than the encoded attributes. Some form of signal analysis in the renderer, for example, may look at aspects of the sound not described by attributes, but may gainfully use these aspects to control a rendering process. For example, a renderer may analyze audio data (rather than or in addition to attributes) to determine how to apply depth processing. Such analysis of the audio data, however, is made more effective in certain embodiments because of the inherent separation of delivered objects as opposed to channel-mixed audio, where objects are mixed together.

Although not shown, the object-based encoder 112 can be moved from the audio object creation system 110 to the content server 120. In such an embodiment, the audio object creation system 110 can upload audio objects instead of audio streams to the content server 120. A streaming module 122 on the content server 120 could include the object-based encoder 112. Encoding of audio objects can therefore be performed on the content server 120 in some embodiments. Alternatively, the audio object creation system 110 can stream encoded objects to the streaming module 122, which can decode the audio objects for further manipulation and later re-encoding.

By encoding objects on the content server 120, the streaming module 122 can dynamically adapt the way objects are encoded prior to streaming. The streaming module 122 can monitor available network 130 resources, such as network bandwidth, latency, and so forth. Based on the available network resources, the streaming module 122 can encode more or fewer audio objects into the audio stream. For instance, as network resources become more available, the streaming module 122 can encode relatively more audio objects into the audio stream, and vice versa.

The streaming module 122 can also adjust the types of objects encoded into the audio stream, rather than (or in addition to) the number. For example, the streaming module 122 can encode higher priority objects (such as dialog) but not lower priority objects (such as certain background sounds) when network resources are constrained. Features for adapting streaming based on object priority are described in greater detail in the '442 application, incorporated above. For example, object priority can be a metadata attribute that assigns objects a priority value or priority data that encoders, streamers, or receivers can use to decide which objects have priority over others.

From the receiver 140A point of view, the object-based decoder 142A can also affect how audio objects are streamed to the object-based receiver 140A. For example, the object-based decoder 142A can communicate with the streaming module 122 to control the amount and/or type of audio objects streamed to the receiver 140A. The object-based decoder 142A can also adjust the way audio streams are rendered based on the playback environment, as described in the '422 application.

In some embodiments, the adaptive features described herein can be implemented even if an object-based encoder (such as the encoder 112) sends an encoded stream to the streaming module 122. Instead of assembling a new audio stream on the fly, the streaming module 122 can remove objects from or otherwise filter the audio stream when computing resources or network resources are constrained. For example, the streaming module 122 can remove packets from the stream corresponding to objects that are relatively less important or lower priority to render.

For ease of illustration, this specification primarily describes object-based audio techniques in the context of streaming audio over a network. However, object-based audio techniques can also be implemented in non-network environments. For instance, an object-based audio program can be stored on a computer-readable storage medium, such as a DVD disc, Blu-ray disc, a hard disk drive, or the like. A media player (such as a Blu-ray player) can play back the object-based audio program stored on the disc. An object-based audio package can also be downloaded to local storage on a user system and then played back from the local storage. Object-compatible media players can render the objects, while legacy media players may be able to still render at least a portion of the audio program.

It should be appreciated that the functionality of certain components described with respect to FIG. 1 can be combined, modified, or omitted. For example, in one implementation, the audio object creation system 110 can be implemented on the content server 120. Audio streams could be streamed directly from the audio object creation system 110 to the receivers 140. Many other configurations are possible.

III. Backwards-Compatible Encoding and Decoding Embodiments

As described above, the object-based encoder 112 can encode some or all objects of an audio soundfield into audio channels for backwards compatibility and encode some or all of these objects of the soundfield into supplemental or extension objects. Initially, the encoder 112 can select which objects are to be considered supplemental or extension objects. For convenience, objects that are encoded into audio channels that are not extension objects are referred to herein as base objects. The delineation between base and extension object can be determined automatically, manually, or by a combination of the same.

In one embodiment, the base objects primarily provide the benefit of backwards-compatibility to legacy receivers. More generally, however, in other embodiments the base objects are not only for backwards compatibility, but also for at least some playback scenarios where extension objects are used by advanced renderers.

Figure 2:
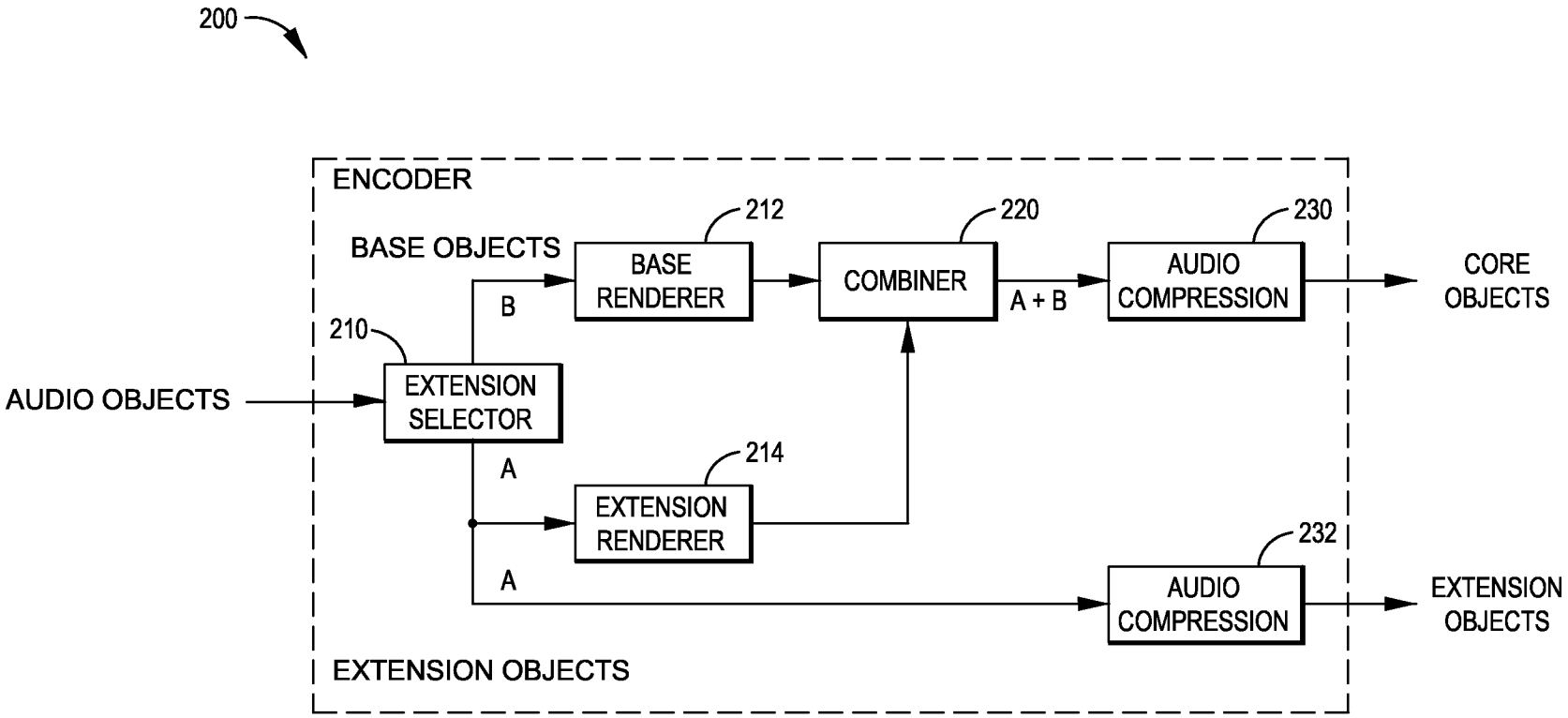
FIG. 2 illustrates an embodiment of an object-based audio encoder.

FIG. 2 illustrates a more detailed embodiment of an object-based audio encoder 200, which can implement some or all of the features of the encoder 112 described above. The encoder 200 receives audio objects as inputs, which may be provided electronically by a content creator user or which may be programmatically accessed by the encoder 200 from a network or computer storage. These audio objects may have been created using the object creation module 114. Advantageously, in certain embodiments, the encoder 200 can automatically select which of the objects to encode as base objects and which of the objects to select as extension objects for potential object-based rendering.

Each of the blocks shown in the encoder 200 and in blocks of subsequent Figures can be implemented in hardware and/or software. In one embodiment, some or all of the blocks in FIG. 2 and in subsequent Figures represent algorithmic or program flow, at least some aspects of which may be performed in parallel (e.g., using different processing units, cores, or DSP circuits). Parallel processing is not required, however, and is not necessarily implemented in some embodiments.

The audio objects input into the encoder 200 are initially received by an extension selector 210. In one embodiment, the extension selector 210 selects one subset of the input objects as a set of base objects and the remaining input objects as a set of extension objects. Each extension object can include an input object or a combination of one or more input objects. The extension selector 210 can perform this selection based on manual or automatic input. For instance, in one embodiment, the extension selector 210 outputs a user interface, which can be accessible by a content creator user, who manually selects base and extension objects. In another embodiment, the audio objects already include metadata (e.g., provided automatically or by the content creator user) that indicates whether the objects are base or extension objects. In such an embodiment, the extension selector 210 can read the object metadata and assign the objects as base or extension objects accordingly.

In still other embodiments, the extension selector 210 automatically chooses which objects are to be base objects and which are to be extension objects. Detailed example criteria for assigning objects as base or extension objects is described below with respect to FIG. 3. However, generally speaking, the extension selector 210 can be configured to select any amount of the audio objects as extension objects, including up to all of the input audio objects, or none of the input audio objects. Settings that control the automatic object selection behavior of the extension selector 210 can be adjusted by a user.

In the depicted embodiment, the extension selector 210 provides a set of base objects ("B") to a base renderer 212 and provides a set of extension objects ("A") to an extension renderer. The base renderer 212 can map the base objects to one or more audio channels or to a bit stream or distribution stream that represents channel data, with each audio channel intended for playback by a separate loudspeaker at a receiver. The audio channels can be considered channel objects and may include any number of channels, such as a mono channel, or a stereo set of left and right channels, or surround sound channels (e.g., 5.1 channels, 6.1, 7.1, or more etc.). The base renderer 212 can use any of a variety of techniques to perform this mapping or rendering. One technique that the base renderer 212 may employ is Vector-Base Amplitude Panning (VBAP), for example, as described in Pulkki, V., "Virtual Sound Source Positioning Using Vector Base Amplitude Panning," J. Audio Eng. Soc., Vol. 45, No. 6, June 1997, which is hereby incorporated by reference in its entirety. The base renderer 212 may use other panning techniques or other rendering techniques to create one or more channel objects in addition to or instead of VBAP.

In some or all of these rendering techniques, the base renderer 212 can use objects' audio data (sometimes referred to herein as audio essence) and/or information encoded in the objects' metadata to determine which channel to render an object to. If an object includes a coordinate position that is to the left of a listener, for instance, the base renderer 212 can map the object to a left channel of a stereo or surround channel arrangement. As another example, if an object's metadata includes velocity information that represents movement from a listener's left to the listener's right, the base renderer 212 can map the object to a left channel initially and then pan the object to a right channel. In another example, the base renderer 212 blends objects over two or more channels to create a position between two speakers at the receiver. More complex rendering scenarios are possible, especially for rendering to surround sound channels. For instance, the base renderer 212 can render an object on multiple channels or panning through multiple channels. The base renderer 212 can perform other effects besides panning in some implementations, such as adding delay, reverb, or any audio enhancement.

The extension renderer 214 can perform some or all of the same techniques as the base renderer 212 to map the extension objects to one or more output channels. If they perform the same rendering, they may be combined into one block (1012) fed from the sum of all objects (A+B) as in FIG. 10, described in detail below. For instance, the extension renderer 214 can implement VBAP rendering. However, the extension renderer 214 need not perform the same processing as the base renderer 212. In addition, the extension renderer 214 need not output audio data for the same number of channels as are output by the base renderer 212.

The output of the extension renderer 214 is combined with the output of the base renderer 212 with a combiner 220 to produce a distribution stream. In one embodiment, the combiner 220 downmixes the output of the two renderers 212, 214 into a distribution stream. The combiner 220 can combine the two outputs by summing sample values together corresponding to the same channels at the instances in time. For example, if the base renderer 212 and extension renderer 214 both output stereo channels, the combiner 220 can add the samples from each stereo channel at the same instants in time together. In situations where the extension renderer 214 or base renderer 212 render at least some different channels, the combiner 220 can include data from each channel output by the two renderers 212, 214 in the distribution stream (e.g., by interleaving channel data). In another embodiment, the combiner 220 matrix encodes the output of one or both of the renderers 212, 214. In another embodiment, one or both of the renderers 212, 214 matrix encode their outputs prior to combining by the combiner 220.

The output of the combiner 220 is optionally provided to an audio compression block or compressor 230, which can perform any available audio compression algorithm to the bit stream (e.g., using codecs such as AC-3, DTS, or Ogg Vorbis). The output of the audio compression block 230 (or combiner 220 if compression is not used) is a bitstream labeled "core objects" in FIG. 2. These core objects can include a rendering of some or all of the input audio objects that is backwards-compatible with legacy receivers. Separately, the extension selector 210 can provide the extension objects to an optional audio compression block or compressor 232. The audio compression block 232 can also use any available compression algorithm to compress the extension objects, independent of the compression choice made for 230. The output of the audio compression block 232 (or the extension selector 210 if compression is not used) is the (optionally compressed) extension objects. Although the extension objects may be compressed, they are still referred herein as extension objects for convenience.

Thus, the output of the encoder 200 in some embodiments includes both backwards-compatible core objects and extension objects. Thus, an object-based decoder in a receiver can remove some or all of the extension objects from the core object stream, play some or all of the core objects, and perform object-based rendering on some or all of the extension objects. Such a decoder (see, e.g., FIG. 4) can thereby provide an enhanced listening experience. Legacy decoders, on the other hand, can play back the core objects while ignoring the extension objects. The extension objects may be in a format, for instance, that is unreadable by legacy decoders and hence ignored. However, since the core objects can include a rendering of some or all of the extension objects as well as the base objects, a legacy receiver can play back most or all of the soundfield represented by the audio objects, albeit at lower quality than an object-based receiver.

Although described as including channel objects, the core objects need not be a collection of channels in some implementations. Further, the encoder may provide an increasingly detailed soundfield at an object-based receiver by combining an increasing number of extension objects with the core objects. The distribution stream need not contain both core objects and extension objects at all times and in all applications: a distribution stream may include solely core objects or extension objects.

Figure 3:
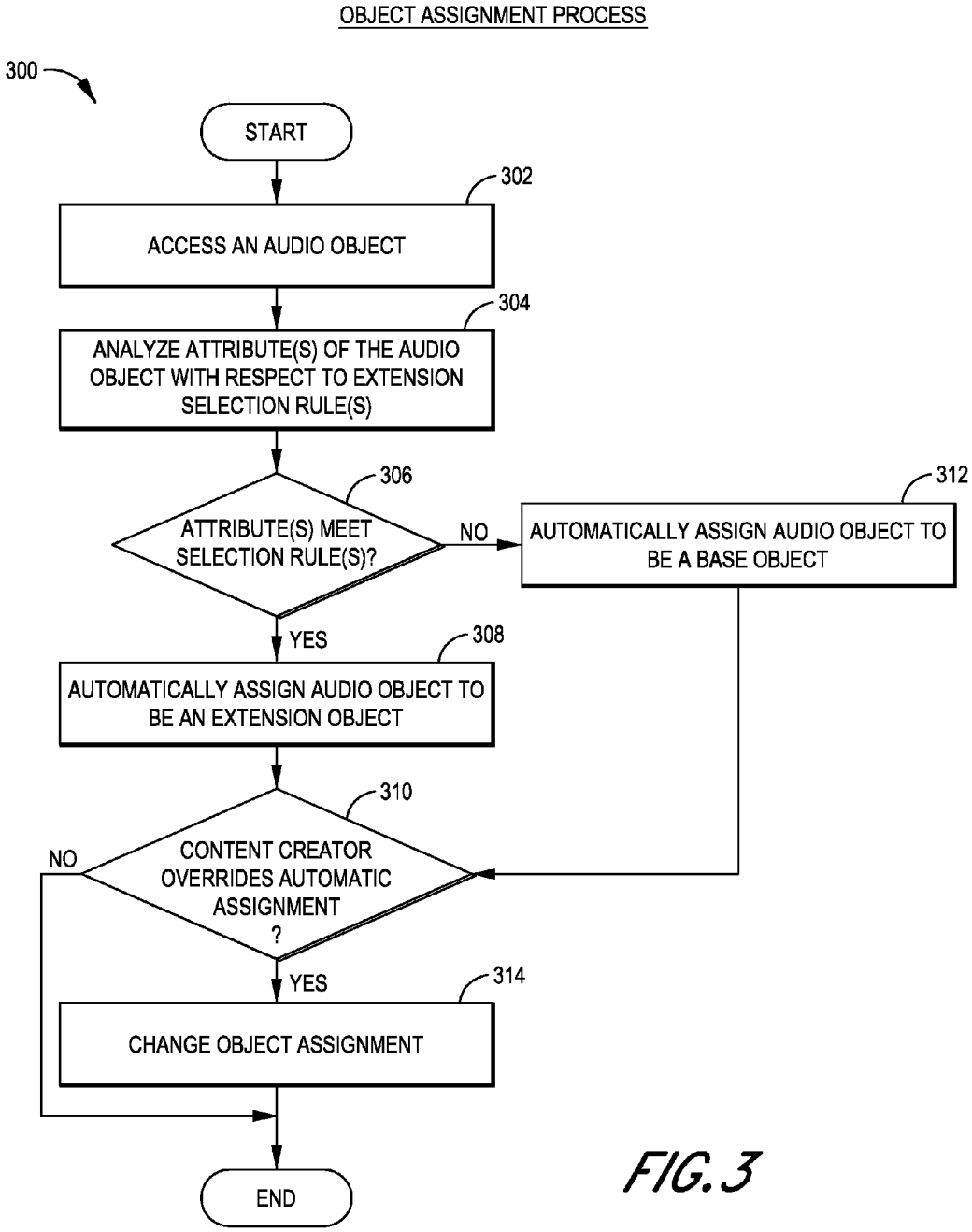
FIG. 3 illustrates an embodiment of an object assignment process.

FIG. 3 illustrates an embodiment of an object assignment process 300 that can be implemented by the encoder 200 or the encoder 112. In particular, the object assignment process 300 focuses on example automatic object assignment functionality of the extension selector 210 described above. Advantageously, in certain embodiments, the automatic object assignment functionality of the extension selector 210 can relieve a content creator user's burden in manually assigning audio objects to be base or extension objects.

At block 302 of the process 300, the extension selector 210 accesses an audio object received as an input to the encoder 200. The process 300 is therefore described with respect to a single audio object for ease of illustration, although it should be understood that the process 300 can be extended to process multiple audio objects. At block 304, the extension selector 210 analyzes one or more attributes of the audio object with respect to one or more object assignment rules. The one or more object assignment rules can define one or more criteria for assigning objects to be base objects or extension objects. Examples of these rules are described in detail below.

If, at decision block 306, the extension selector 210 determines that an object should be assigned as an extension object, the extension selector 210 automatically performs this assignment at block 308. Otherwise, the extension selector 210 automatically assigns the object to be a base object at block 312. From block 308 or 312, the process 300 continues to block 310, where the extension selector 210 determines whether a content creator overrides the automatic object assignment. In some embodiments, content creator users can reassign extension objects to be base objects and vice versa, using a user interface, scripting or other programming language, or the like. If the content creator overrides the automatic object assignment, the extension object selector 210 changes the object assignment at block 314.

In more detail, the process by which the extension selector 210 can separate input objects into base and extension object subsets can depend on any number of object selection rules or factors. As an example of an object selection rule, if an object includes dynamic (e.g., moving) audio information, it can be a good candidate for an extension object. Conversely, another object selection rule can state that static objects, such as background music, atmospheric sounds, and the like, are good candidates for base objects. Yet another object selection rule can state that objects in motion are good candidates for extension objects in some embodiments because they can be rendered to provide more pronounced 3-D, spatial, or psychoacoustic rendering than static (e.g., non-moving or barely moving objects), among other reasons. Similarly, another object selection rule can state that an object that moves longer than a predetermined time or faster than a predetermined rate can also be classified as an extension object.

As other examples of selection rules, objects whose position leaves the plane of the speakers (such as a hypothetical plane connecting 5 speakers in a 5.1 surround configuration) can be an extension object. An audio object representing an object flying overhead of the listener is a good example of an object that may be out of the plane of the speakers. Like objects in motion, objects that are outside of the speaker plane can be good candidates for enhanced 3-D, spatial, or psychoacoustic rendering. Similarly, objects who are not within a specified locus or distance of the core objects (e.g., as defined by coordinate values in the objects' metadata) may be assigned to be extension objects.

Although dynamic (e.g., moving or out of plane) objects are often good candidates for extension selection, a static (e.g., nonmoving) object that is designated for a particular speaker, such as dialog, can be an extension object as well. One criteria for extension object selection of a static audio object is if the content creator user decides that this object is deserving of its own particular rendering. Thus, the content creator user can instruct the extension selector 210 to automatically assign dialog or other such objects to be extension objects. Alternatively, the content creator user can change a static object, such as dialog, to be an extension object after the automatic assignment process (see blocks 310, 314 of FIG. 3).

Additional object selection or assignment rules such as processing power at the receiver, network bandwidth, speaker configurations at the receiver, psychoacoustic relevance (e.g., regarding whether the listener can notice the sound's trajectory) and the like can also be evaluated to determine whether to classify an object as a base or extension object. The more processing power, bandwidth, and/or better speaker configuration available, the more extension objects can be sent to the rendering system in one embodiment. Any combination of the factors described herein or other factors can be evaluated by the audio creation system when classifying objects as base or extension objects. In addition, a further selection of objects may be made downstream (e.g., by the renderer) based on restrictions on computing resources that may not be foreseen by the encoder when initially selecting objects.

Yet another object selection rule is to assign objects based on their priority. As described above, and in further detail in the '442 application (incorporated above), priority can be encoded in an object's metadata. In one embodiment, the extension selector 210 can assign objects with relatively higher priority values to be extension objects while assigning objects with relatively lower priority values as base objects. Higher priority objects may be more impactful in an audio rendering presentation, and it can therefore be desirable in some embodiments to assign these objects as extension objects.

Adding extension objects to the core objects in the bit stream can increase bit rate. If network resources are constrained, a target bit rate may be established for or by the extension selector 210. The extension selector 210 can adapt selection of extension objects automatically, for example, by reducing the relative number or percentage of objects assigned to be extension objects when the target bit rate is relatively lower and by increasing the relative number or percentage of objects assigned to be extension objects when the bit rate is relatively higher.

Another technique that may be employed by the extension selector 210 is to combine multiple input audio objects into extension objects. In one embodiment, the extension selector 210 combines multiple objects with a similar trajectory into a single extension object. An example might be members of a marching band, each represented by an input object initially, but then combined into a single band object by the extension selector. Combining objects can include summing their audio data and combining their metadata. Combining of metadata can include finding the centroid of locations for the various band members (or other measure of centralness or average location) to produce an overall location for the band. In another embodiment, the extension selector 210 combines multi-object groups based on correlation among the objects. Two objects may have the same or similar metadata, for instance, which would permit the two objects to be combined. Combining the objects can include adding the audio samples of the objects together. If the metadata of the two objects is not exactly the same, combining the objects can also include performing operations on the metadata to combine the metadata together. These operations can include, for example, averaging metadata (such as averaging locations or velocities), selecting the metadata of one of the objects to be the metadata of the final, combined object, combinations of the same, or the like.

Another technique that the extension selector 210 may use to select an object for inclusion in base objects is to determine, based at least partly on object metadata, an object's diffuseness, or whether the object is diffuse. Diffuse objects can include objects whose exact position or localization in the rendered soundfield is less discernable to a listener than objects with more precise localizations. For example, environmental sounds related to the weather are often diffuse (although some weather effects may be localized). If an object's metadata indicates that the object is to be rendered over a large area, or if the metadata does not include position information, the extension selector 210 can assign the object to be a base object. In some embodiments, the object may include metadata that explicitly indicates that it is a diffuse object, in which case the extension selector 210 may also assign the object to be a base object.

The extension selector 210 can also determine whether an object is diffuse using techniques other than by examining the object's metadata. For instance, the extension selector 210 can use psychoacoustic analysis techniques to ascertain how diffuse an object may be. For multi-object groups that are related together, for example, as stereo or surround channels, the extension selector 210 can apply psychoacoustic techniques such as calculating channel cross-correlations or calculating a decorrelation factor(s) to determine how diffuse the objects are. If the extension selector 210 determines that such objects are uncorrelated or highly decorrelated (e.g., relative to a predetermined threshold), for instance, the extension selector 210 can determine that these objects are likely diffuse.

The extension selector 210 can, in certain embodiments, apply one or more thresholds to the criteria described above or other criteria to classify objects as base or extension objects. For instance, a threshold can be specified (e.g., by a content creator user or by default) that any object more than 10 degrees out of the speaker plane (or 10 feet, or another value) is a candidate for an extension object. The threshold(s) can be tuned by the content creator user to increase or decrease the number of objects classified as extension objects. The content creator user can have control over the threshold(s) as desired. At the extremes, the extension selector 210 can classify all objects as extension objects or all objects as base objects. Thus, the number of core channel objects can be variable. For example, a two channel stereo core could be selected, a set of surround channels can be selected, or zero core objects may be selected (e.g., all objects are extension objects). Scalability is promoted in certain embodiments by allowing the audio creation system to classify any number or percentage of objects as extension objects.

Object selection may also be done during distribution stream delivery or after the bitstream has been delivered (e.g., by the content server 120 or another component of the object-based audio environment 100). For example, the delivery system may have bandwidth constraints that prevent some or all but the most significant objects from being delivered as extension objects. Or, the receiver may have insufficient processing resources to handle caching or rendering of multiple, simultaneous objects. In these cases, these objects may be discarded, relying on the base channels to represent them. Further, the receiver can output a user interface control that allows a listener to selectively add or subtract objects (base or extension). A user may wish to subtract or attenuate a ballgame announcer object from ballgame audio, for instance. Many other embodiments for controlling the mix of base and extension objects at the content creation end and the rendering end are possible.

Figure 4A:
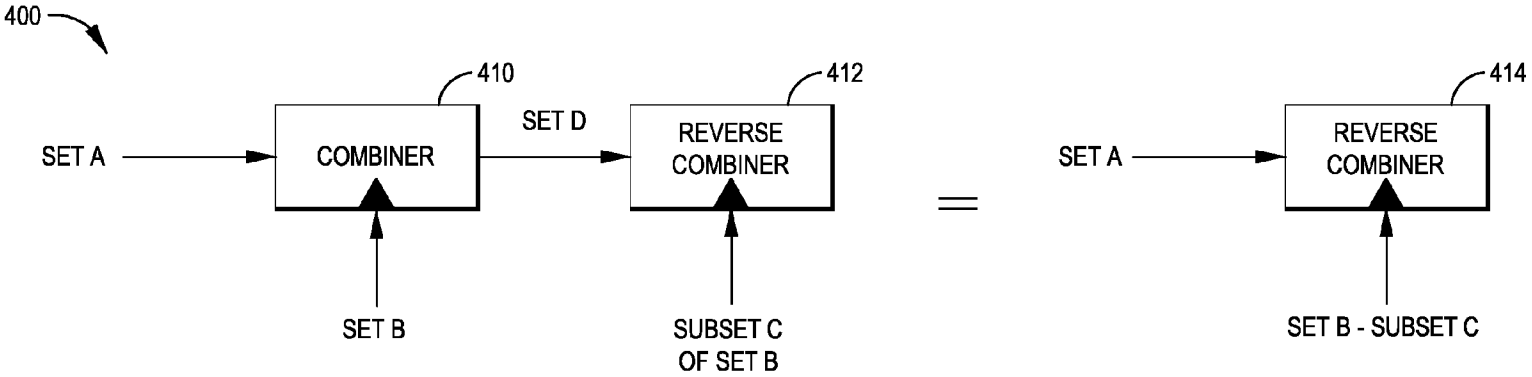
FIG. 4A illustrates an embodiment of a combiner and reverse combiner.
Figure 4B:
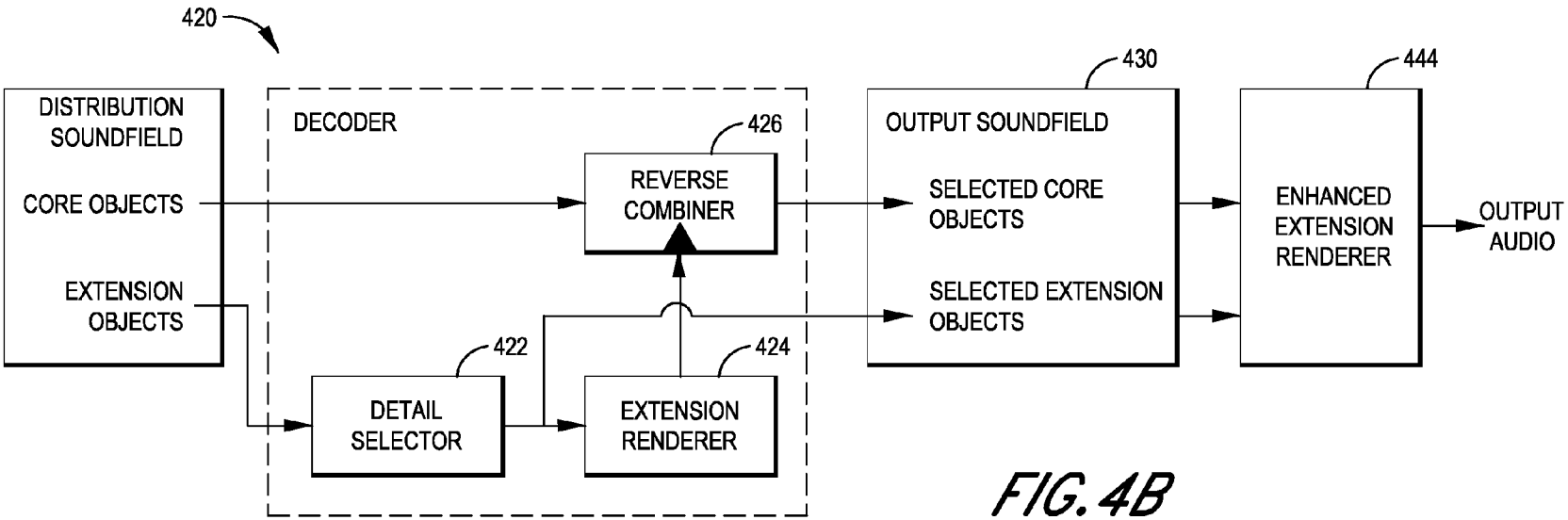
FIG. 4B illustrates an embodiment of an object-based decoder.

FIG. 4A illustrates an embodiment of a combiner and reverse combiner configuration 400 that helps illustrate how an object-based decoder can process core and extension objects (see FIG. 4B).

The combiner 410 can combine sets of objects A and B into a set of objects D (e.g., the core objects output in the encoder 200 above). The specific combiner 410 operation can be dictated by the goals of the target applications. It should, however, be substantially reversible in certain embodiments, within the limits of numerical resolution and compression loss. Specifically, it can be possible to define a reverse combiner 412 in certain embodiments, as shown in FIG. 4A. Receiving as inputs sets D and a subset C of B, the reverse combiner 412 outputs a set of objects that are substantially equivalent to the object set that would have been obtained had subset C not been included originally (as depicted by the equivalent combiner 414). This reversibility can facilitate the selective rendering of extension objects separately from the core objects by non-legacy (e.g., object-rendering enabled) receivers.

FIG. 4B illustrates an embodiment of an object-based decoder 420. A detail selector 422 of the example decoder 420 selects zero or more extension objects which may be rendered individually if an object-rendering system (such as the enhanced extension renderer shown) is present. This selection can be automatically dictated by a variety of factors. One such factor can be available computing resources, such as processing power or memory. The more computing resources available, the more extension objects that the detail selector 422 can extract for enhanced rendering. Another factor can be the target speaker configuration. If the core objects correspond to the local loudspeaker configuration, the detail selector 422 may, for instance, simply output the core objects as-is (e.g., without selecting extension objects to be rendered separately).

The objects selected for separate rendering are passed from the detail selector 422 to an extension renderer 424. The extension renderer 424 can implement the same algorithm(s) used by the extension renderer 214 in the encoder 200 to render the selected extension objects. The resulting rendered audio can then be extracted from the core objects by the reverse combiner 426. Thus, for example, the rendered extension objects can be subtracted from the core objects using the reverse combiner 426. The output of the reverse combiner 426 can then contain the mapping of some or all input soundfield objects minus the extension objects selected by the detail selector 422. Subtracting or otherwise attenuating the extension objects in the core objects can reduce or eliminate redundancy in the output of the decoder 420 and the resulting output soundfield rendered to the local loudspeaker configuration.

The selected core objects in the output soundfield 430 can be provided to one or more loudspeakers based on the core objects' channel assignments (e.g., as determined by the encoder 200). The enhanced extension renderer 444 can render any selected core objects or any selected extension objects using any rendering appropriate for each type of object, such as the depth rendering described above or other 3-D, spatial, or psychoacoustic rendering (among other effects), or even the same rendering implemented by the extension renderer 424. Thus, the output audio provided by the decoder 420 can be enhanced as compared to the output of legacy decoders.

Figure 5:
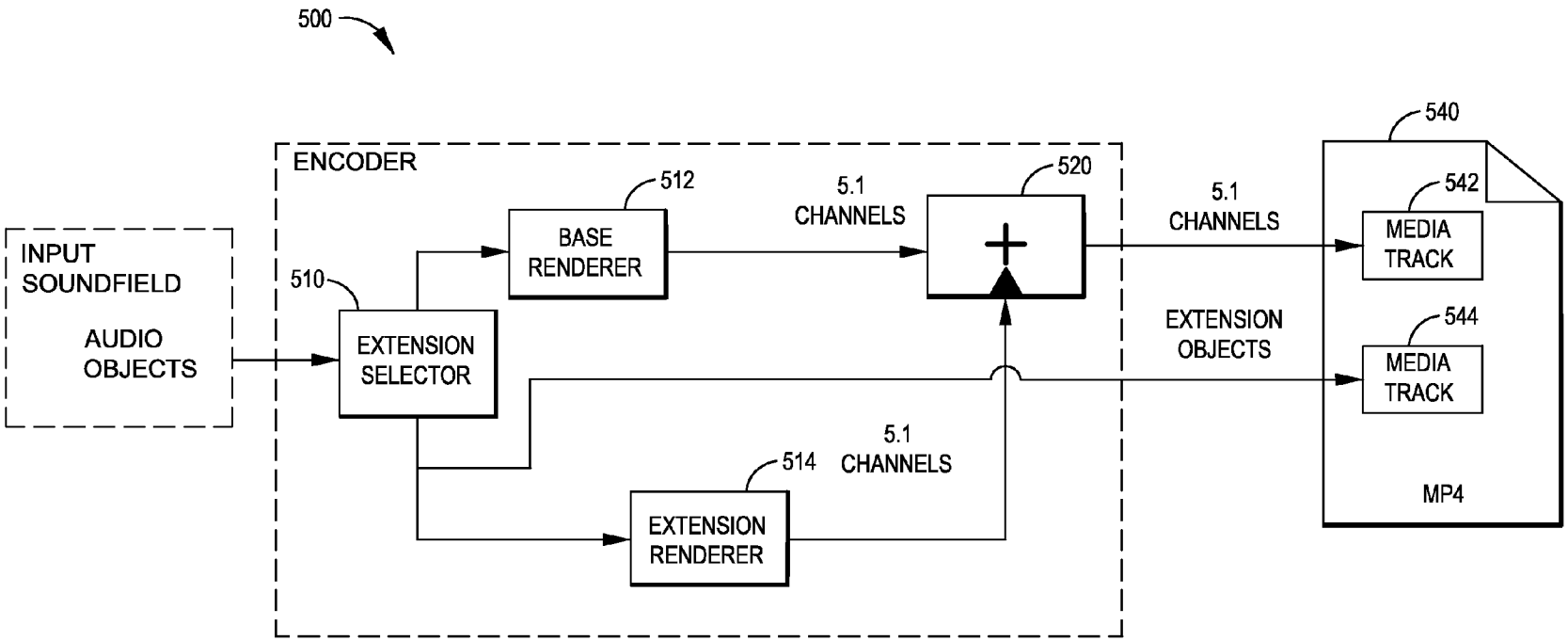
FIG. 5 illustrates another embodiment of an object-based encoder.
Figure 6:
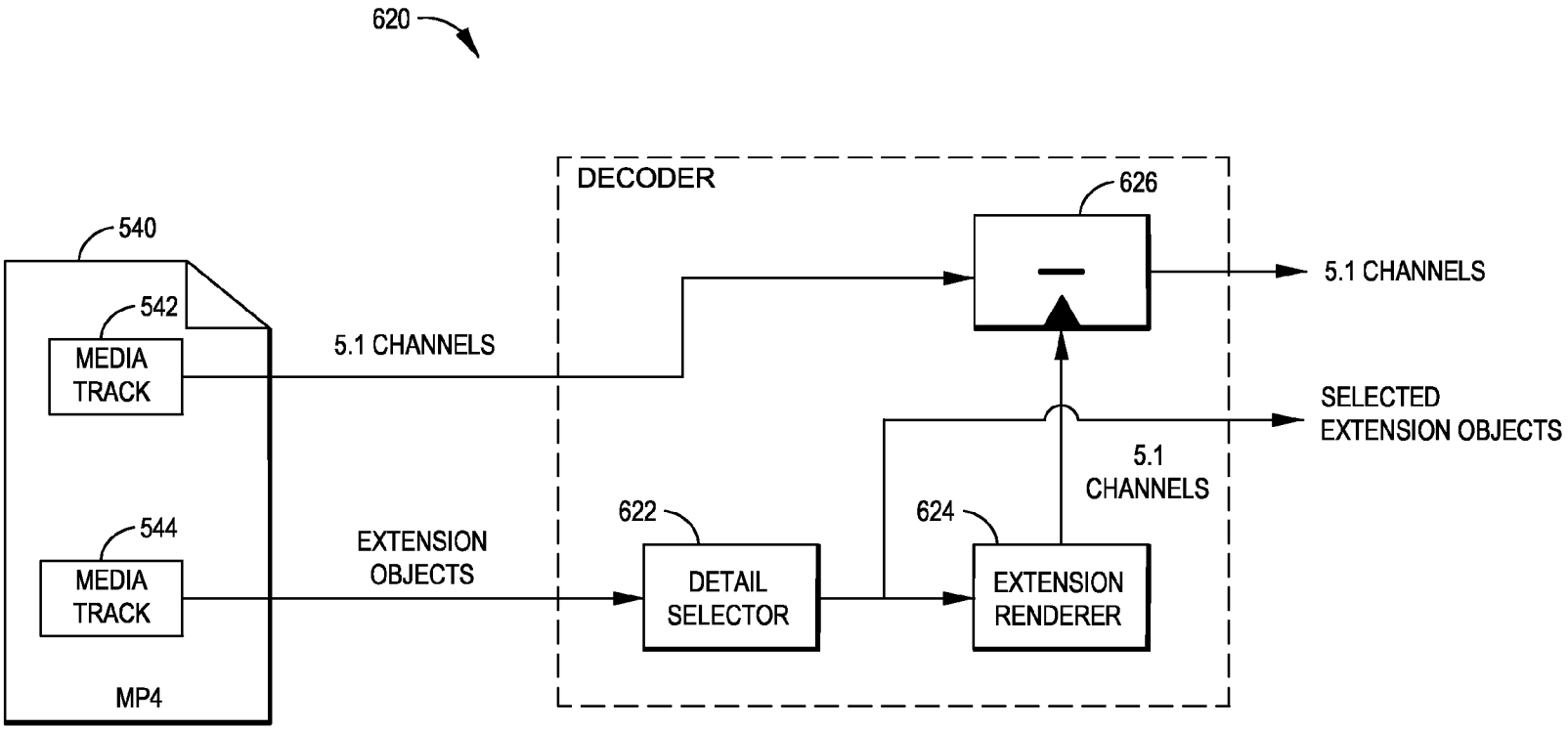
FIG. 6 illustrates another embodiment of an object-based decoder.

FIG. 5 illustrates another embodiment of an object-based encoder 500 that will be used to describe an example theatrical surround (5.1) plus extension objects encoding mix, facilitating retaining compatibility with 5.1-capable home theatre devices. A corresponding decoder 600 is shown in FIG. 6.

The example starts on the soundstage where an object-based soundfield can be created. As part of the creation process, the content creator user may monitor the object-based soundfield on the preferred loudspeaker configuration, e.g. a 11.1 configuration, as well as the common 5.1 theatrical loudspeaker configuration. In the event that the rendering of a particular object crafted for an 11.1 presentation does not satisfy the engineer's creative needs when auditioned on the 5.1 configuration, he or she may specify rendering override instructions with the object, which may specifically map the object to one or more speakers. These rendering override instructions can provide explicit instructions to downstream renderers on how to render the object to a multi-channel configuration, effectively overriding at least some of the rendering that may be performed by the renderer.

The mastered object-based soundfield can be presented to the encoder 500 illustrated in FIG. 5. This encoder 500 can be a specialized version of the encoder 200 illustrated above, including an extension selector 510, base renderer 512, extension renderer 514, and combiner 520. These components can have some or all of the functionality of their respective components described above with respect to FIG. 2. Similarly, referring to FIG. 6, the example decoder 600 shown includes a detail selector 622, extension renderer 624, and reverse combiner 626, each of which may have some or all of the functionality of the corresponding components shown in FIG. 4B. For ease of illustration, the enhanced extension renderer is not shown, but may be included in some embodiments.

Referring to FIG. 5, the encoder 500 can have the following attributes. The core objects output by the encoder 200 can include the traditional 6 theatrical audio channels, namely Left, Right, Center, Left Surround, Right Surround and Low Frequency Effects (Subwoofer). The extension objects can include one or more objects occupying the equivalent of one or more audio channels. The combiner 520 operation can be a simple addition and the reverse combiner 626 (of FIG. 6) a subtraction, where the addition and/or subtraction are performed sample-by-sample. For example, a sample of the base renderer 512 output can be combined with a sample from the extension renderer 514.

The extension renderer 514 maps the input objects into the theatrical 5.1 configuration (e.g., the core objects configuration). Both the extension renderer 514 and base renderer 512 use the downmix coefficients mentioned above whenever present to ensure that the 5.1 content, e.g., core objects, captures the original artistic intent.

The distribution stream can then be processed for distribution. The 5.1 content can be processed using codecs, e.g. AC-3, DTS or Ogg Vorbis. The resulting compressed 5.1 content (provided as media track 542) and the extension objects (provided as media track 544), which can also be processed using a codec for bit rate reduction, can both be multiplexed in a multimedia container 540 such as MP4.

Such an arrangement as shown in FIGS. 5 and 6 could provide significant backward compatibility. Legacy devices would simply process the 5.1 content, while object-based devices could also access the extension objects using a decoder such as the one shown in FIG. 6.

IV. Example Hybrid Object-Based Audio System

In either the pure object-based audio case or the backwards compatible scenarios described above, the streaming of a dynamic number of discrete audio objects can result in the stream having a variable bitrate. The more objects that are presented at the same time, the more extreme the peak bitrate may be. Several strategies exist to mitigate this, such as time staggering the object deliveries to reduce peak demands. For example, one strategy could be to deliver certain extension objects earlier, whenever overall bitrates are lower. As a result, a core objects stream may arrive at a receiver before an extension objects stream. If the stream(s) are buffered, the late arrival of extension objects may not pose a problem to playback of a complete audio presentation, as playback can be delayed until the buffer receives the extension objects.

However, in playback scenarios that begin playback without buffering, substantially instantaneously, a receiver may begin playing received core objects before extension objects arrive. As audio players may be selected to render a complete audio presentation as soon as any audio arrives (such as in trick play scenarios), reduced-quality playback can occur when core objects are available but extension objects are not yet available. When core objects are initially played and the extension objects are subsequently received, the audio player may then begin rendering the extension objects, resulting in a sudden change to a more complete or enhanced playback experience. This sudden transition can be noticeable to a listener and may be perceived as an undesirable initial poor playback quality.

To address some or all of these deficiencies, an audio coding system can combine discrete audio object coding with parametric audio object coding to enable the distribution stream to better serve widely varying delivery and playback conditions and to better meet user performance expectations. In particular, by delivering both discrete audio objects and their representations based on parametric coding, it can become possible to satisfy the competing aspects of high sound quality, efficient bitrates, and quick-start access to the complete soundfield. For example, in one embodiment, a hybrid object-based audio system can be provided that transmits parametric data comprising object representations together with audio objects. This object representations may be very compact and add little to the bitrate of the audio stream, while having some information about spatial or other rendering effects. For ease of illustration, the remainder of this specification refers solely to parametric data. However, it should be understood that other forms of object reconstruction information or object representations besides parametric data may also be used in any of the embodiments described herein.

A hybrid object-based receiver can receive the object representations along with at least some of the audio objects (such as the core objects) and begin playback of the audio while rendering the object representations. The rendering of the object representations can provide at least a partially enhanced audio effect at least until extension object information (e.g., extension objects or object metadata) arrives at the receiver. Once the object information arrives, the receiver can crossfade into rendering the object information. This transition from object representations rendering to object information rendering may be less perceptible to a user than the jarring delayed rendering scenario described above.

Figure 7:
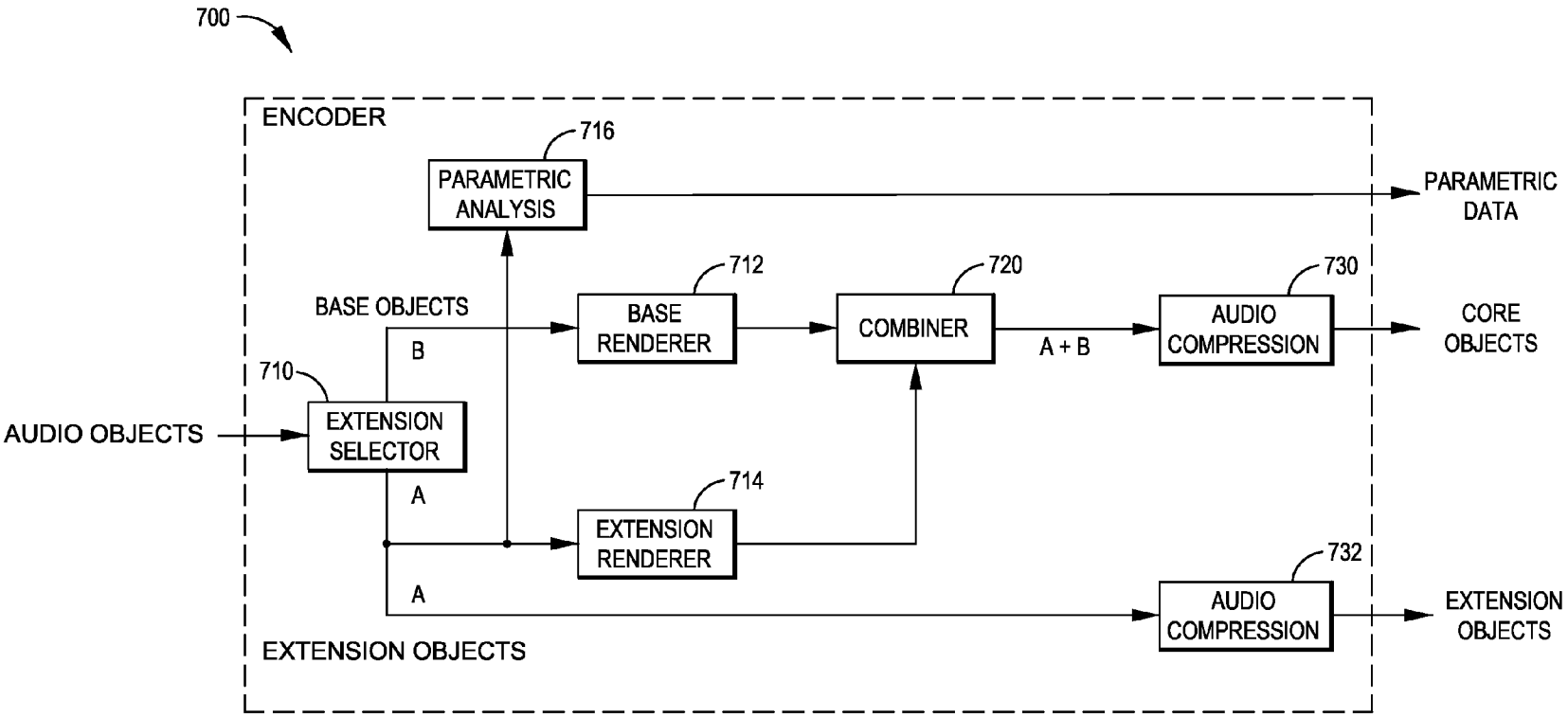
FIGS. 7 through 10 illustrate embodiments of object-based encoders that encode parametric audio data in addition to object data.
Figure 8:
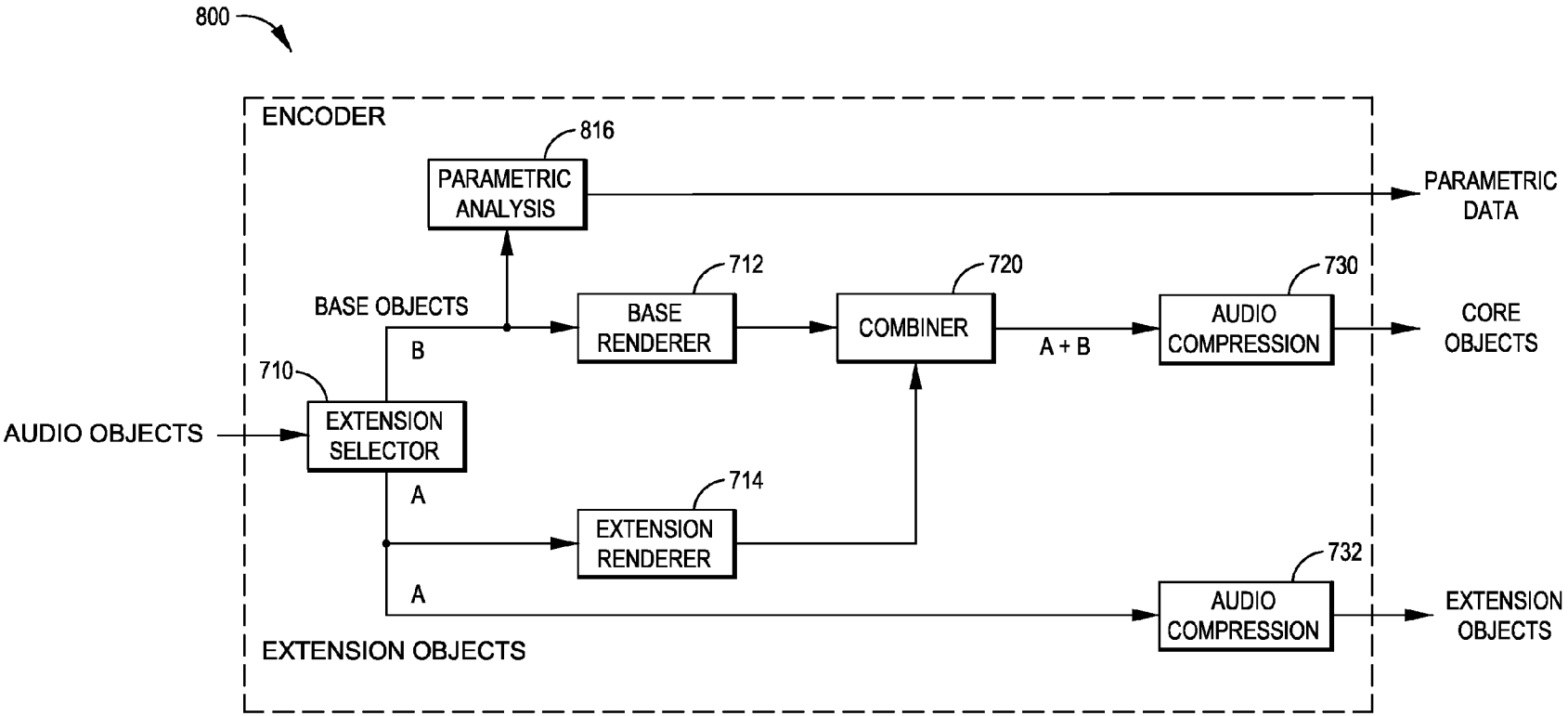
Figure 9:
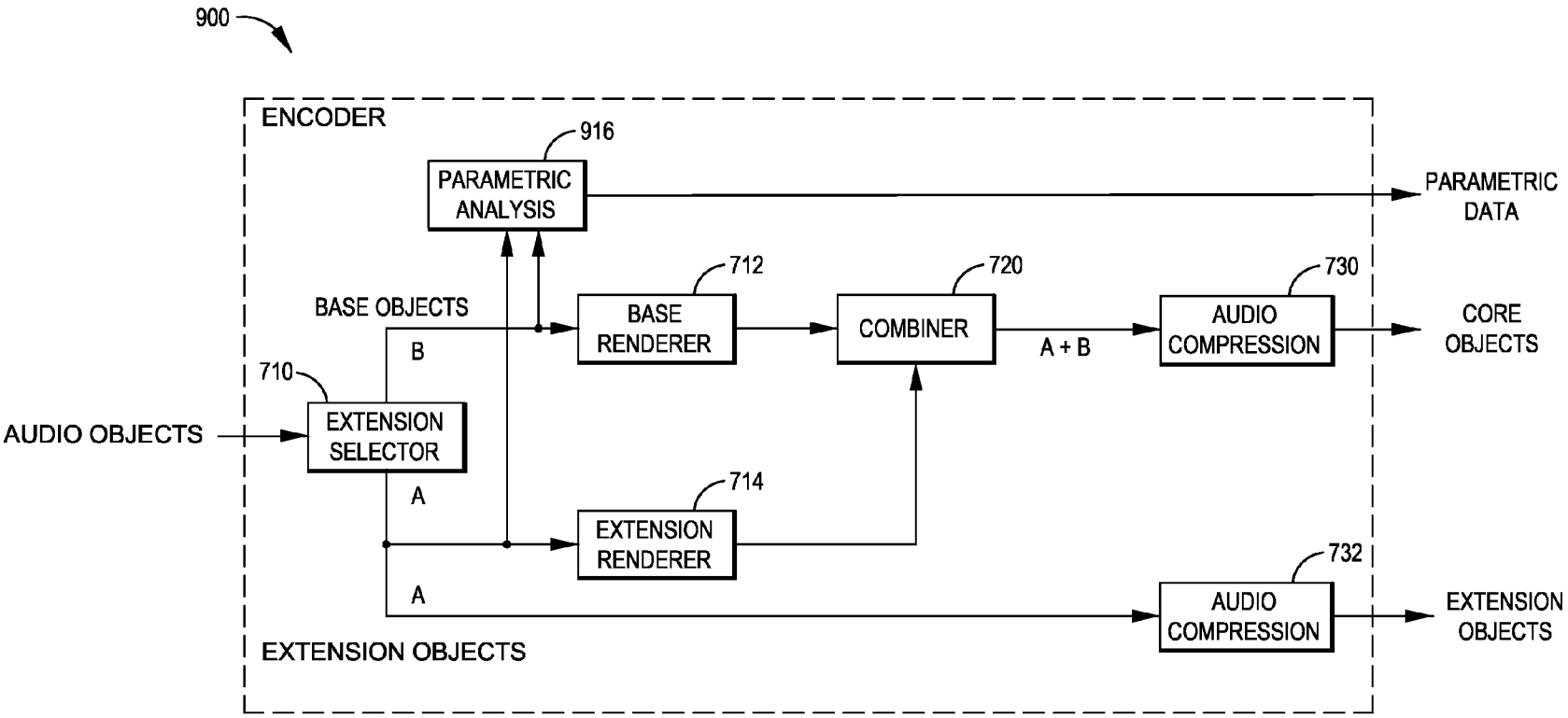

FIGS. 7 through 10 illustrate embodiments of object-based encoders 700-1000 that encode parametric audio data in addition to object data. In FIGS. 7 through 9, the encoders 700-900 each include features of the encoders 112, 200 described above. For example, these encoders 700-900 each include an extension selector 710, a base renderer 712, an extension renderer 714, a combiner 720, and optional audio compression blocks or compressors 730, 732. These components can have the features of their respective components described above. In addition to these features, a parametric analysis block 716, 816, 916 is provided in each encoder 700-900. The parametric analysis blocks 716, 816, 916 are examples of object reconstruction components that can generate object reconstruction information.

In the depicted embodiment of the encoder 700, the parametric analysis block 716 provides parametric data representing the extension objects (A). Since the parametric data can be relatively low bitrate, it can be delivered concurrently with the core objects. The parametric data can therefore facilitate the ability to extract objects during trick play or program acquisition, thereby allowing the full soundfield to be rendered, albeit temporarily with limited quality until the discrete extension objects are received at the receiver. Providing parametric data with the core objects also can enable receivers to present the complete soundfield in cases where some or all of the extension objects have been lost or shed in the delivery chain (e.g., due to a lower priority assignment), as may occur with stream interruptions or bandwidth limitations. The decoder, described below with respect to FIGS. 11 through 12, can be designed to transition seamlessly between parametrically delivered objects and discrete objects.

When sound quality is of primary importance, the distribution stream may be stored or transmitted in its native LPCM format; it may be losslessly compressed; or it may be lossy compressed with a suitable choice of codec and bitrate so as to achieve the desired level of audio quality. It can be also possible to use a combination of lossy and lossless coding, or different quality levels of lossy coding, on a per-object basis, to achieve sufficient overall audio quality while minimizing delivery payload.

When even further reductions in delivery bitrates are desired, additional lossy coding techniques may be employed. One such technique is spatial audio coding. Rather than carrying each audio signal as a discrete entity, they are analyzed to determine their temporal/spectral/positional characteristics which are translated to efficient parametric descriptions. The multiple source audio signals are then rendered to a compatible audio format, typically mono or stereo but possibly 5.1, with the parametric data delivered in a separate path. Even though the parametric data can be very compact compared with the original audio essence after low bitrate audio coding, it can be sufficient to enable the spatial audio decoder to effectively extract the original audio from the downmixed audio. If the playback decoder ignores the parametric data, a complete downmix presentation remains thus ensuring compatibility with legacy playback systems.

Thus, in certain embodiments, the parametric analysis block 716 performs spatial audio coding to produce the parametric data. In the depicted embodiment, the parametric analysis block 716 creates the parametric data from the extension objects output by the extension selector 710. Thus, the parametric data output by the parametric analysis block 716 can be a relatively low-bitrate representation of the extension objects (e.g., as compared with the bitrate of the extension objects themselves). As a result, if the parametric data is received before the higher bitrate extension objects at the receiver, the receiver can render the parametric data at least until the extension objects arrive. Listeners may perceive this transition from parametric to extension objects less readily than a transition from no extension object rendering to full extension object rendering.

One of the most prominent examples employing parametric coding for audio is codified in the MPEG SAOC (Spatial Audio Object Coding) international standard, ISO/IEC 23003-2, which is hereby incorporated by reference in its entirety, and which can be implemented by any of the parametric analysis blocks 716, 816, 916 described herein. However, as mentioned above, the parametric data may be of lower quality than the extension objects. This lower quality comes in part due to lower bitrate but also due to the fact that the extracted, parametric audio signals are not perfect replicas of the originals. The imperfection can be primarily a result of crosstalk from any concurrent signals that happen to occupy the same frequency spectra as the object of interest.

Whether the crosstalk is audible or objectionable depends on several factors. The fewer the number of playback speakers in use, the more freely a listener may move about the playback environment without detecting the crosstalk. However in home theaters or automotive environments, many more speakers are employed to address multiple, non-ideal seating locations. As listeners sit closer to some speakers and further from others, the masking of the crosstalk may fail, degrading the sound quality. Additionally, if the frequency responses of the many speakers are not uniform and smooth, this can also lead to a failure in crosstalk masking.

Assuming the rendering system has avoided these issues, listeners may not only experience good sound quality from parametrically coded audio, some of the key flexibility benefits described earlier for discrete object-based audio presentation may be realized. For example, making small adjustments in the relative levels of the audio objects (as in the tweaking of vocals or the adjustment of crowd noise) usually presents no problem for the resulting sound quality, as all the audio elements remain sufficiently well represented to satisfy the masking process. However, as the object levels are adjusted more extremely, as in the Karaoke or hearing impaired cases, the crosstalk within each object may become exposed, thus noticeably degrading the sound quality.

Within the context of any given parametric coding technology, the degree of immunity to crosstalk masking failure can be determined by the specifics of the parameterization design and the time/frequency resolution of the parametric description, which in turn can affect how the total delivery payload can be allocated between audio essence and parametric data. The higher the acuity of the parametric representation, the greater may be the proportion of parametric data relative to audio data, which can compromise the basic fidelity of the coded audio essence.

Even with generous parametric data and essence data allocation it may not be possible to achieve transparent audio quality using parametric coding. To address this, MPEG SAOC supports the technique of encoding additional "residual" signals that enable specific objects selected during encoding to achieve full waveform reconstruction when decoded. While this technique would solve the more critical "isolated dialog" crosstalk problem, the residual coding data significantly increases the bitrate for the duration of the object, thus negating the efficiency advantages of parametric coding.

Until now, delivery systems for object-based audio have made a binary choice to use only parametric coding or to use only discrete object essence coding, neither of which completely satisfies the wide range of system operational and performance requirements. Improved strategies for balancing the conflicting requirements of delivery efficiency, user playback functionality, and sound quality for object-based audio content would therefore be desirable in the market. The hybrid approach to encoding (and decoding) described herein in FIGS. 7 through 12, in certain embodiments, advantageously combines discrete and parametric coding methods to achieve these and/or other benefits.

Referring to FIG. 8, another embodiment of an encoder 800 is shown that includes a parametric analysis block 816. Like the parametric analysis block 716, the parametric analysis block 816 can perform spatial audio coding to produce parametric data. However, in the depicted embodiment, the parametric analysis block 816 obtains parametric data from the base objects mix output by the extension selector 710. Obtaining parametric data from the base mix can facilitate access to objects that contributed to the base mix that were not delivered as discrete extension objects (A), which may enable new playback rendering features unanticipated when the original object extensions were selected. For example, a renderer may find a use for an object that was encoded as a base object instead of as an extension object. The base object may have been encoded as a core object mistakenly by the extension selector or by a content creator user, or the renderer may simply have a new use for the base object that was not foreseen at extension selection time. Providing a parametric data of the base objects can enable the renderer to at least partially reconstruct the desired base object for subsequent rendering. This option for creating parametric data for base objects can future proof the renderer by enabling such new capabilities.

Referring to FIG. 9, another embodiment of an encoder 900 is shown that includes a parametric analysis block 916. Like the parametric analysis blocks 716, 816, the parametric analysis block 916 can perform spatial audio coding to produce parametric data. However, the parametric analysis block 916 generates parametric data representing both sets of base and extension objects (A+B), which can combine the benefits of the previous two scenarios in FIGS. 7 and 8.

Thus, a discrete object-based content delivery system may be supplemented with parametric data representing base objects separately from extension objects, or a combination of base and extension objects (e.g., audio objects A, B, A+B), or any other subset of the various objects available, as may best suit the application (as determined automatically and/or with manual user input). The system may also choose to rely solely on parametric representations for a certain subset of less sensitive extension objects, or when the number of simultaneous objects exceeds some threshold value.

In FIGS. 7 through 9, the base renderer 712 and extension renderer 714 may be the same or different. As described above, the particular extension renderer 714 used in the encoder 700, 800, or 900 can be similar or identical to the extension renderer used in the decoder (see FIGS. 11 and 12), in order to ensure or attempt to ensure that the decoder's reverse combiner (1124) completely (or substantially) removes the extension objects from the core objects, thereby recovering the original base objects with reduced or minimal crosstalk. As in the above embodiments described with respect to FIGS. 1 through 6, the separate base renderer 712 can provide the option of applying different rendering characteristics to the base objects than the extension objects, which may enhance the aesthetics of the compatible core objects mix.

Figure 10:
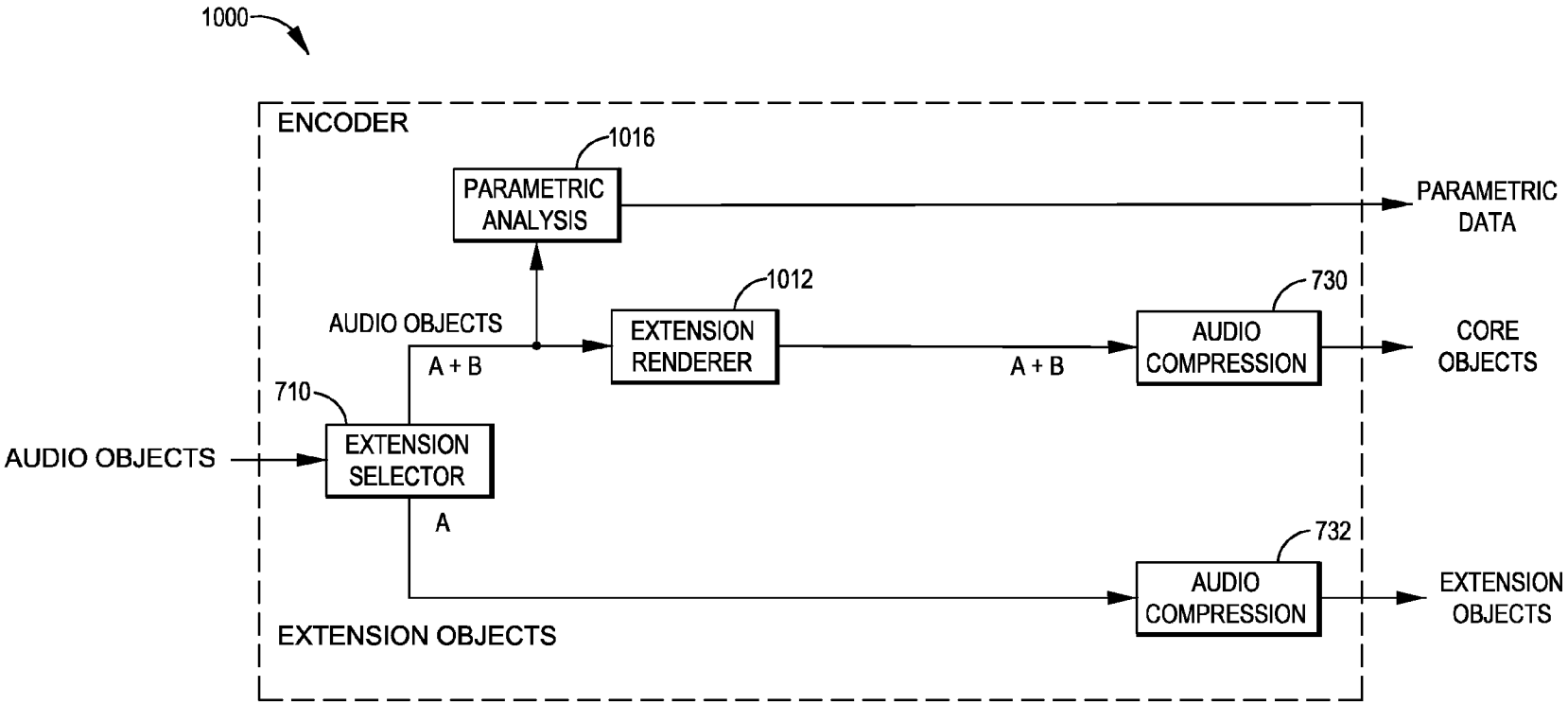

Shown in FIG. 10 is another example encoder 1000. This encoder 1000 uses an extension renderer 1012 for both base and extension objects, which simplifies encoder complexity and satisfies one possible goal that the extension renderers in encoder and decoder be similar or identical. The same base and extension objects are provided to a parametric analysis block 1016, which enables the parametric analysis block 1016 to provide parametric data for some or all objects (A+B). Parametric analysis block 1016 may have some or all of the features of the parametric analysis blocks described above. The encoder 1000 shown can also be used without the parametric analysis block 1016 in place of any of the encoders described above with respect to FIGS. 1-6.

Figure 11:
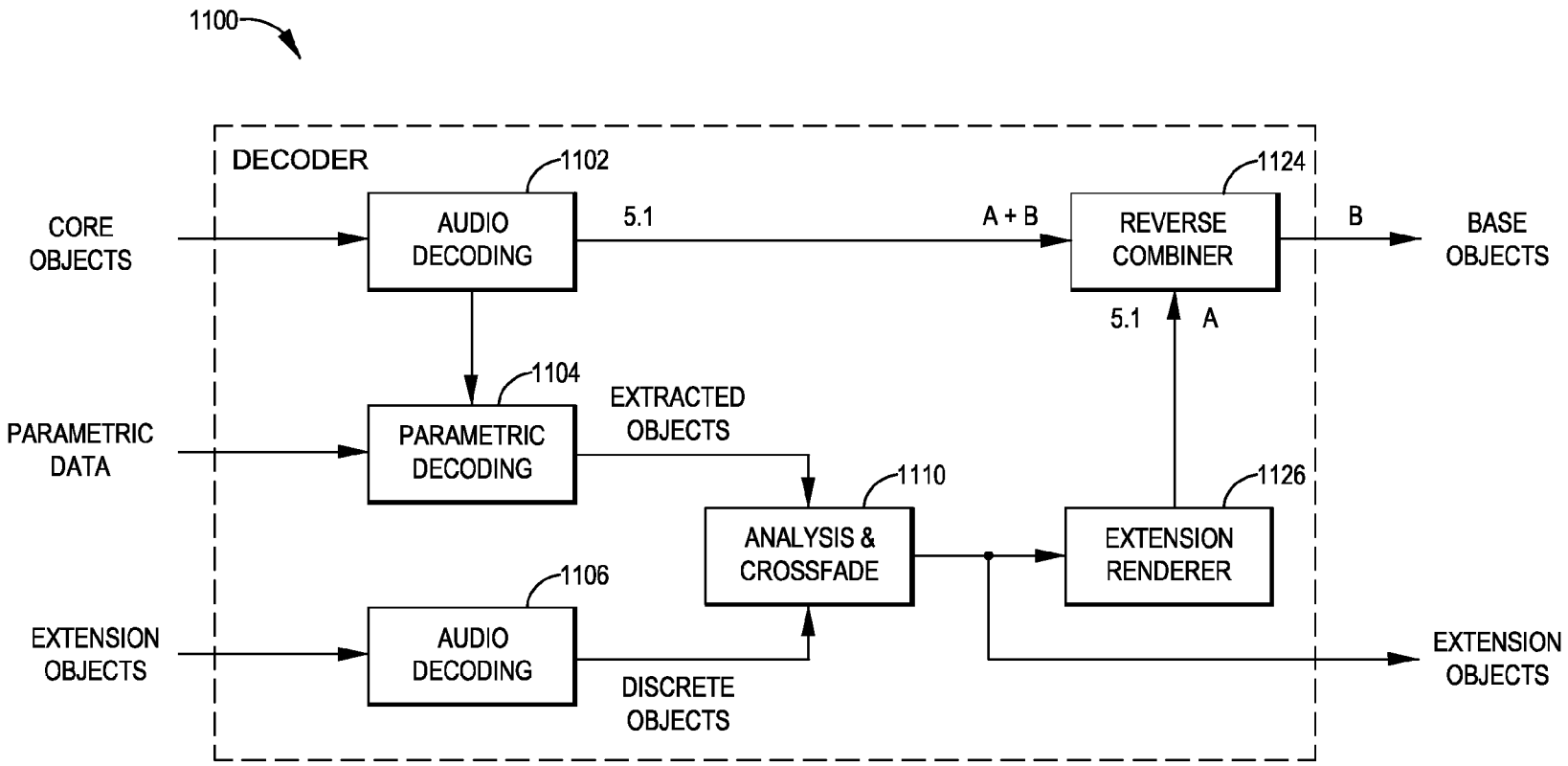
FIGS. 11 and 12 illustrate embodiments of decoders that selectively decode parametric audio data in addition to or instead of decoding object data.
Figure 12:
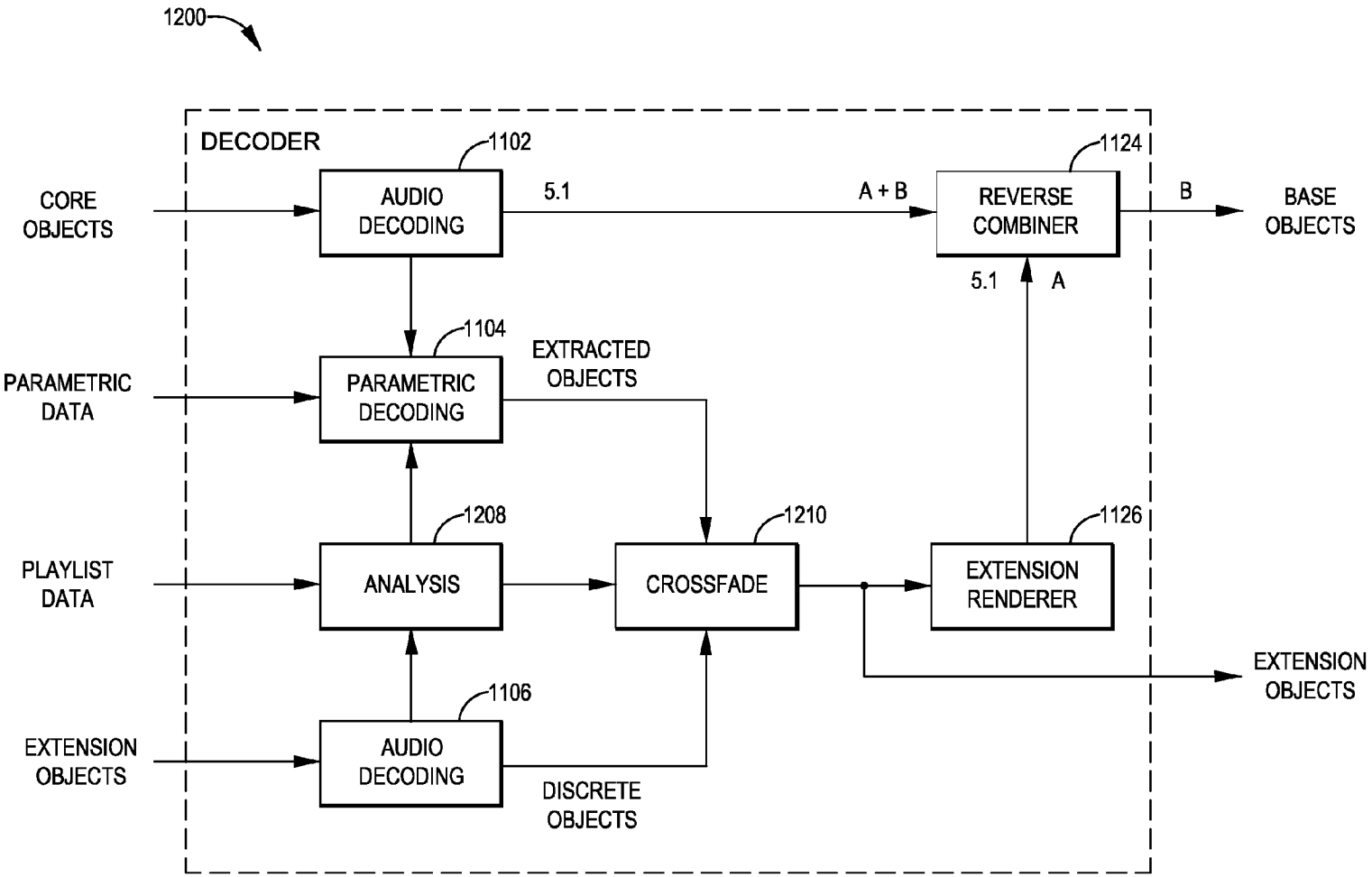

FIGS. 11 and 12 illustrate embodiments of decoders 1100, 1200 that selectively decode parametric audio data in addition to or instead of decoding object data. Referring to FIG. 11, the decoder 1100 receives core objects, parametric data, and extension objects, which may be in the form of a bit stream or the like. An audio decoding block 1102 decodes the core objects into one or more channels (e.g., stereo, 5.1, or the like). The audio decoding block 1102 can decompress the core objects if compressed.

The parametric decoding block or decoder 1104 decodes the parametric data, for example, by processing the core audio essence with the parametric data to produce extracted objects. If the parametric data represents extension objects (e.g., as encoded by the encoder 700 of FIG. 7), the extracted objects output by the parametric decoding block 1104 can approximate those extension objects. The extracted objects are provided to an analysis and crossfade block 1110.

The audio decoding block 1106 decodes the extension objects to produce discrete objects, for example, by decompressing the extension objects if they are delivered in compressed form. If the objects are already in linear pulse code modulation (LPCM) form, the audio decoding block 1106 takes no action in one embodiment. The discrete extension objects are also provided to the analysis and crossfade block 1110.

As described above, the discrete extension objects may be preferred to the parametric, extracted objects due to the inherent sound quality advantages from the discrete, extension objects. Therefore, whenever discrete extension objects are present, in certain embodiments the crossfade block 1110 passes them forward (e.g., to an enhanced extension renderer such as the renderer 444). Whenever discrete extension objects are absent and parametric extracted objects are present, in certain embodiments, the crossfade block 1110 passes the extracted objects forward (e.g., to the enhanced extension renderer). If discrete objects become available while extracted objects are actively passing through the crossfade block 1110, the block 1110 can perform a crossfade from extracted objects to discrete objects, thereby attempting to provide higher quality objects whenever possible.

The extension objects forwarded by the crossfade block 1110 can be available to the downstream playback system (e.g., enhanced extension renderer) to present as desired, and can also be rendered by the extension renderer for use by the reverse combiner 1124. The reverse combiner 1124 can subtract the output of the extension renderer 1126 from the core objects to obtain the base objects as described above. Thus, if the parametric data is output by the crossfade block 1110 to the extension renderer 1126, the parametric data can be rendered and subtracted from the core objects by the reverse combiner 1124.

FIG. 12 illustrates another example decoder 1200 that can further compensate for lost or missing extension objects during streaming. The decoder 1200 includes certain components included in the decoder 1100, such as decoding blocks 1102, 1104, and 1106, the reverse combiner 1124, and the extension renderer 1126. The decoder 1200 also receives playlist data, which can include a metadata file or the like that describes the structure of the audio program received by the decoder 1200. In one embodiment, for example, the playlist data includes an extensible markup language (XML) file or the like that contains metadata of the audio objects as well as pointers to audio essence (such as audio files or other audio data) corresponding to those objects. In one embodiment, the playlist data contains a list of the extension objects that an encoder plans to send to the decoder 1200. The decoder 1200 can use this playlist data to intelligently determine when to decode parametric data so as to potentially save computing resources when no extension objects are expected. (It should be noted that the playlist data described herein can also be provided by any of the encoders described above and received by any of the decoders described above.)

In addition to the problem of object information being delayed at the start of audio playback, object information may also be unavailable during playback due to other factors such as network congestion. Consequently, object information may be lost partway through a streaming session, resulting in loss of audio enhancement midway through playback. To combat this, parametric data can be rendered whenever object information is missing to at least partially compensate for the missing object information.

Object information may suddenly drop from an audio stream, which could result in a perceptible delay before the parametric objects can be rendered in the object information's place. Two different approaches can be used to combat this difficulty. One approach is to continuously render the parametric data in the background and switch to this parametric data output whenever object information is lost. Another approach is to buffer the audio input signal (e.g., 30 ms or another buffer size) and use a look-ahead line to determine whether object information is about to be lost, and then rendering the parametric data in response. This second approach may entail more processing efficiency, although both approaches can be used successfully.

The playlist data in the depicted embodiment of FIG. 12 may be created by any of the encoders described above. In one embodiment, the extension selector creates a playlist as the extension selector selects extension objects, inserting the name or other identifier of each selected extension object in the playlist, among other object metadata. Alternatively, another component (such as the streaming module 122) can analyze the extension objects selected by the extension selector and create the playlist data. In yet another embodiment, if the extension objects are pre-selected by a content creator user with the object creation module 114 prior to encoding, the object creation module 114 can create the playlist data.

An analysis block 1208 of the decoder 1200 receives and reads the playlist data. If the playlist data indicates the presence of an extension object, and the analysis block 1208 confirms that the extension object has been received, the analysis block 1208 can send a control signal to set a crossfade block 1210 to pass the discrete extension object forward (e.g., to an enhanced extension renderer). Optionally, the analysis block 1208 can deactivate the parametric decoding block 1104 in response to detecting the presence of extension objects in order to reduce computing resource usage. If the playlist data indicates the presence of an extension object, and the analysis block 1208 fails to confirm the presence of that object (e.g., it has not been received), the analysis block 1208 can activate the parametric decoding block 1104 if it was not already active and can set the crossfade block 1210 to pass the extracted parametric object forward. If the extension object is received or otherwise becomes available while an extracted parametric object is actively passing through the crossfade block 1210, the crossfade block 1210 can perform a crossfade transition from the extracted parametric object input to the discrete extension object input.

V. Terminology

Many other variations than those described herein will be apparent from this disclosure. For example, depending on the embodiment, certain acts, events, or functions of any of the algorithms described herein can be performed in a different sequence, can be added, merged, or left out all together (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially. In addition, different tasks or processes can be performed by different machines and/or computing systems that can function together.

The various illustrative logical blocks, modules, and algorithm steps described in connection with the embodiments disclosed herein can be implemented as electronic hardware, computer software, or combinations of both. To clearly illustrate this interchangeability of hardware and software, various illustrative components, blocks, modules, and steps have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of the disclosure.

The various illustrative logical blocks and modules described in connection with the embodiments disclosed herein can be implemented or performed by a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor can be a microprocessor, but in the alternative, the processor can be a controller, microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration. Although described herein primarily with respect to digital technology, a processor may also include primarily analog components. For example, any of the signal processing algorithms described herein may be implemented in analog circuitry. A computing environment can include any type of computer system, including, but not limited to, a computer system based on a microprocessor, a mainframe computer, a digital signal processor, a portable computing device, a personal organizer, a device controller, and a computational engine within an appliance, to name a few.

The steps of a method, process, or algorithm described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of non-transitory computer-readable storage medium, media, or physical computer storage known in the art. An exemplary storage medium can be coupled to the processor such that the processor can read information from, and write information to, the storage medium. In the alternative, the storage medium can be integral to the processor. The processor and the storage medium can reside in an ASIC. The ASIC can reside in a user terminal. In the alternative, the processor and the storage medium can reside as discrete components in a user terminal.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, certain embodiments of the inventions described herein can be embodied within a form that does not provide all of the features and benefits set forth herein, as some features can be used or practiced separately from others.

What is claimed is:

1. A method of decoding object-based audio, the method comprising:

under control of a hardware processor, receiving, with a receiver, a plurality of audio objects, the audio objects comprising one or more channels of audio and a plurality of extension objects, wherein the extension objects are other than audio channels, and wherein the extension objects comprise audio data and metadata describing attributes of the audio data;

rendering at least some of the extension objects with the receiver to produce rendered extension audio;

combining the one or more audio channels with the rendered extension audio to produce output audio channels, said combining comprising subtracting samples of the rendered extension audio from the one or more audio channels;

rendering the at least some of the extension objects into enhanced extension audio; and providing the output audio channels and the enhanced extension audio to a speaker for playback as output audio.

2. The method of claim 1, further comprising selecting a subset of the extension objects to be rendered based on one or more selection criteria.

3. The method of claim 2, wherein said selecting comprises selecting relatively fewer objects in response to determining that computing resources are relatively more constrained and selecting relatively more objects in response to determining that computing resources are relatively less constrained.

4. The method of claim 1, further comprising receiving parametric data representing a spatially-coded version of one or both of the extension objects and the one or more channels of audio.

5. The method of claim 4, further comprising decoding the parametric data to produce an approximate reproduction of one or more initial audio objects encoded in the one or more channels of audio.

6. The method of claim 4, further comprising:

determining whether a second set of extension objects has been received; and in response to determining that the second set of extension objects has not been received, decoding the parametric data to produce extracted objects and rendering the extracted objects.

7. The method of claim 6, further comprising crossfading from rendering the extracted objects to rendering the second set of extension objects in response to receiving the second set of extension objects.

8. The method of claim 7, further comprising:

receiving playlist data descriptive of a second set of extension objects;

looking ahead in a buffer to determine whether a selected one of the second set of extension objects has been received;

in response to determining that the selected one of the second set of extension objects has not been received, decoding the parametric data to produce extracted objects; and rendering the extracted objects.

9. The method of claim 1, wherein the rendering the at least some extension objects into enhanced extension audio further comprises rendering the at least some extension objects to a speaker configuration at the receiver.

10. A system for decoding object-based audio, the system comprising:

a hardware processor comprising:

a detail selector configured to receive a plurality of audio objects, the audio objects comprising one or more channels of audio and a plurality of extension objects, wherein the extension objects are other than audio channels, and wherein the extension objects comprise audio data and metadata describing attributes of the audio data;

a first extension renderer configured to render at least some of the extension objects to produce rendered extension audio;

a reverse combiner configured to combine the one or more audio channels with the rendered extension audio to produce output audio channels, said combining comprising subtracting samples of the rendered extension audio from the one or more audio channels; and a second extension renderer configured to render the at least some of the extension objects into enhanced extension audio and provide the output audio channels and the enhanced extension audio to a speaker for playback as output audio.

11. The system of claim 10, wherein the detail selector is further configured to select a subset of the extension objects to be rendered based on one or more selection criteria.

12. The system of claim 11, wherein the detail selector is further configured to perform said selection by at least selecting relatively fewer objects in response to determining that computing resources are relatively more constrained and selecting relatively more objects in response to determining that computing resources are relatively less constrained.

13. The system of claim 10, further comprising a parametric decoder configured to receive parametric data representing a spatially-coded version of one or both of the extension objects and the one or more channels of audio.

14. The system of claim 13, wherein the parametric decoder is further configured to decode the parametric data to produce an approximate reproduction of one or more initial audio objects encoded in the one or more channels of audio.

15. The system of claim 13, further comprising a component configured to at least:

determine whether a second set of extension objects has been received; and in response to determining that the second set of extension objects has not been received, decode the parametric data to produce extracted objects and rendering the extracted objects.

16. The system of claim 15, further comprising a crossfade component configured to crossfade from rendering the extracted objects to rendering the second set of extension objects in response to receiving the second set of extension objects.

17. The system of claim 16, further comprising an analysis block configured to:

receive playlist data descriptive of a second set of extension objects;

look ahead in a buffer to determine whether a selected one of the second set of extension objects has been received;

in response to determining that the selected one of the second set of extension objects has not been received, decode the parametric data to produce extracted objects; and render the extracted objects.

18. The system of claim 10, wherein the renderer is further configured to render the at least some extension objects into enhanced extension audio by at least rendering the at least some extension objects to a speaker configuration at the receiver.

* * * * *